US011594849B2

(12) United States Patent
Sloey et al.

(10) Patent No.: US 11,594,849 B2
(45) Date of Patent: Feb. 28, 2023

(54) INTEGRATED HIGH FREQUENCY CONNECTOR

(71) Applicant: Apple Inc., Cupertino, CA (US)

(72) Inventors: Jason S. Sloey, Cedar Park, TX (US); Ibuki Kamei, San Jose, CA (US); Timothy B. Ogilvie, San Jose, CA (US); Daniel C. Wagman, Scotts Valley, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/577,325

(22) Filed: Jan. 17, 2022

(65) Prior Publication Data

US 2022/0216657 A1 Jul. 7, 2022

Related U.S. Application Data

(63) Continuation of application No. 16/585,421, filed on Sep. 27, 2019, now Pat. No. 11,228,149.

(51) Int. Cl.

| | |
|---|---|
| ***H01R 24/50*** | (2011.01) |
| ***H01R 13/6585*** | (2011.01) |
| ***H01R 12/73*** | (2011.01) |
| ***H01R 12/52*** | (2011.01) |

(52) U.S. Cl.

CPC ..... *H01R 24/50* (2013.01); *H01R 12/52* (2013.01); *H01R 12/732* (2013.01); *H01R 13/6585* (2013.01)

(58) Field of Classification Search

CPC ..... H01R 24/50; H01R 12/52; H01R 12/732; H01R 13/6585

See application file for complete search history.

(56) References Cited

U.S. PATENT DOCUMENTS

| | | | | |
|---|---|---|---|---|
| 7,074,085 | B2 * | 7/2006 | Chen | H01R 13/658 439/108 |
| 8,272,881 | B2 * | 9/2012 | Miyazaki | H01R 12/716 439/74 |
| 9,209,540 | B2 | 12/2015 | Raff | |
| 9,225,115 | B2 | 12/2015 | Malek | |

(Continued)

*Primary Examiner* — Abdullah A Riyami
*Assistant Examiner* — Nader J Alhawamdeh
(74) *Attorney, Agent, or Firm* — Kilpatrick Townsend & Stockton, LLP

(57) ABSTRACT

High-speed connectors that save space in an electronic device, are simple to connect, and are readily manufactured. One example can provide a high-speed connector having high-speed connections. The high-speed connections can be integrated with low-speed connections in a board-to-board structure to save space in an electronic device. An example can provide high-speed connections that are simple to connect. The board-to-board structure can include a board-to-board plug, where each high-speed connection includes a high-speed contact having a lateral portion. The lateral portion can include right-angle tabs to guide a central conductor of a coaxial cable. The central conductor of each coaxial cable can be soldered to a corresponding lateral portion. Ground contacts for the board-to-board plug can include crimping portions to connect to an outer shield of each coaxial cable. These high-speed connectors can be readily manufactured by utilizing stamped contacts and molded housings.

20 Claims, 24 Drawing Sheets

(56) References Cited

U.S. PATENT DOCUMENTS

| | | | | |
|---|---|---|---|---|
| 2013/0023162 | A1* | 1/2013 | Harlan | H01R 24/60<br>439/660 |
| 2013/0295784 | A1* | 11/2013 | Hasegawa | H01R 12/73<br>439/55 |
| 2015/0222062 | A1 | 8/2015 | Sloey | |
| 2021/0098952 | A1* | 4/2021 | Sloey | H01R 24/50 |
| 2022/0216657 | A1* | 7/2022 | Sloey | H01R 12/79 |

* cited by examiner

INTEGRATED HIGH FREQUENCY CONNECTOR

CROSS-REFERENCE TO RELATED APPLICATIONS

This application is a continuation of U.S. application Ser. No. 16/585,421, filed Sep. 27, 2019, which is incorporated by reference.

BACKGROUND

The number of types of electronic devices that are commercially available has increased tremendously the past few years and the rate of introduction of new devices shows no signs of abating. Devices such as tablet, laptop, desktop, and all-in-one computers, cell phones, storage devices, wearable-computing devices, portable media players, navigation systems, monitors, adapters, and others, have become ubiquitous.

The functionality of these devices has likewise greatly increased. This has led to increased complexity inside these electronic devices. An electronic device can now include one or more processors, radios, displays, and other components. At the same time, the demand for smaller and thinner devices continues unabated. As a result, space inside electronic devices is at a premium and saving it is a constant priority.

The inclusion of some of these circuits, such as the radios, can necessitate the use of high speed data lines from one internal component to another. High-speed connector structures, such as coaxial cables, can be used. Coaxial connectors can include a shielded conductor terminating at each end in a connector insert or plug. Signals can then be conveyed from a first receptacle on a first board, through a coaxial cable to a second receptacle, which can be located on the first or a second board.

But these connectors can consume a large amount of board space. That is, each receptacle has a footprint of its own that can consume area on a board. Also, each coaxial receptacle might need a certain amount of space between itself and other coaxial receptacles and devices.

Connections can be made using these connectors during device assembly. If a connection is difficult to form, it can slow the assembly process, increase costs, and increase the amount of rework that might need to be done. For this reason, it can be desirable for the connection to be simple to make.

Also, some of these electronic devices can be manufactured in very high volumes. To meet demand for these products, it can be desirable that these connectors be readily manufactured.

Thus, what is needed are high-speed connectors that save space in an electronic device, are simple to connect, and are readily manufactured.

SUMMARY

Accordingly, embodiments of the present invention can provide high-speed connectors that save space in an electronic device, are simple to connect, and are readily manufactured. An illustrative embodiment of the present invention can provide a high-speed connector having high-speed connections for a coaxial cable, a shielded trace on a board, or other high-speed interconnect structure. The high-speed connections can be integrated with low-speed contacts in a board-to-board structure to save space in an electronic device. These and other embodiments of the present invention can provide high-speed connections that are simple to connect. The board-to-board structure can include a board-to-board plug, where each high-speed connection includes a high-speed contact having a lateral portion. The lateral portion can include right-angle tabs to guide or position a central conductor of a coaxial cable. The central conductor of each coaxial cable can be soldered to a corresponding lateral portion. Ground contacts for the board-to-board plug can include crimping portions to connect to an outer shield of each coaxial cable. These and other embodiments of the present invention can provide high-speed connections that are readily manufactured by relying on stamped contacts and molded housings.

In these and other embodiments of the present invention, the high-speed contacts can be shielded by ground structures on the high-speed connector. These ground structures can be laterally around or can surround the high speed contacts on one, two, three, four, or more sides. This shielding can protect signals on the high-speed contacts from coupling by noise and other signals, and can protect other signals from coupling from signals on the high-speed contacts. The ground structures can include ground contacts that can be located adjacent to high-speed signal contacts, as well as ground shields that can be located around a perimeter and other locations on the high-speed connector.

In these and other embodiments of the present invention, connections to high-speed contacts can be made via high-speed signal traces on a board, such as a printed circuit board or flexible circuit board. The high-speed signal traces can be shielded by ground or other low-impedance lines on two or more sides. The high-speed traces can connect to a high-speed contact in either a plug or receptacle of the high-speed connector. The shielding ground lines can connect to ground contacts and ground shields that can laterally be positioned around or can surround the high-speed contact.

In these and other embodiments of the present invention, one or more low-speed contacts can be replaced with one or more larger power or other contacts. In these and other embodiments of the present invention the low-speed contacts can be omitted and the high-speed connector can include an array of high-speed contacts.

While embodiments of the present invention are well-suited to providing high-speed connectors that include connections for coaxial cables, other embodiments of the present invention can provide high-speed connectors that can include connections for one or more other types of cables, such as twin-axial, twisted pair, shielded twisted pair, fiber optic, single conductor, or other types of cables and combinations of these and coaxial cables.

In these and other embodiments of the present invention, contacts, ground contacts, ground shields, and other conductive portions of a high-speed connector can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions can be formed using injection or other molding, 3-D printing, machining, or other manufacturing process. The nonconductive portions can be formed of silicon or silicone, rubber, hard rubber, plastic, nylon, liquid-crystal polymers (LCPs), or other nonconductive material or combination of materials.

These and other embodiments of the present invention can provide high-speed connectors that can be located in various types of devices, such as portable computing devices, tablet computers, desktop computers, laptops, all-in-one computers, cell phones, wearable-computing devices, storage devices, portable media players, navigation systems, monitors, power supplies, adapters, remote control devices, audio devices, chargers, and other devices. These high-speed connectors can provide pathways for signals that are compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
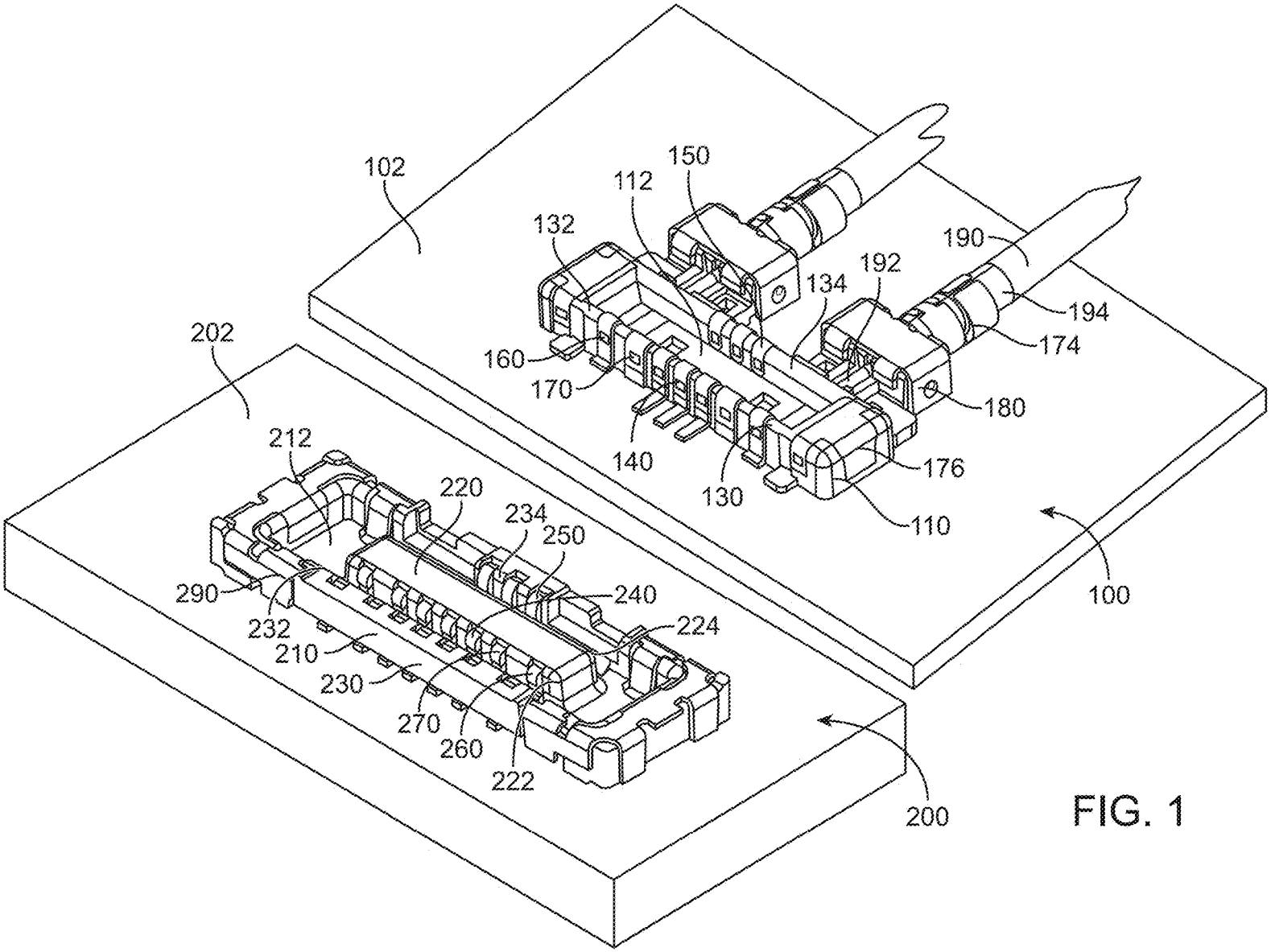
FIG. 1 illustrates a high-speed connector according to an embodiment of the present invention.

FIG. 1 illustrates a high-speed connector according to an embodiment of the present invention. This high-speed connector can include board-to-board receptacle 200 and board-to-board plug 100. This figure, as with the other included figures, is shown for illustrative purposes and does not limit either the possible embodiments of the present invention or the claims.

Board-to-board receptacle 200 can be located on board 202 and board-to-board plug 100 can be located on board 102. Boards 202 and 102 can be printed circuit boards, flexible circuit boards, or other appropriate substrate. Board-to-board plug 100 can include connections for one or more coaxial cables 190. A center conductor 192 of coaxial cable 190 can connect to high-speed contacts 160. High-speed contacts 160 can be shielded by ground contacts 170 and ground shields 176. This shielding can protect signals conveyed by the coaxial cables 190 from interference by other signals. This shielding can also protect other signals from interference by signals conveyed by coaxial cables 190.

Coaxial cables 190 can be fixed to board-to-board plug 100 by crimping portions 174. Crimping portions 174 can be tightened around coaxial cable 190 to hold coaxial cable 190 in place. Crimping portions 174 can also physically and electrically connect to a shielding 194 or braided layer of coaxial cable 190. Center conductors 192 of coaxial cables 190 can be shielded by ground shields 180 and can connect to high-speed contacts 160. High-speed contacts 160 can be supported by housing 110. Housing 110 can include a central recess 112 surrounded by raised outer portion 130. Raised outer portion 130 can include a first edge 132 and a second edge 134. Ground contacts 170 and ground shields 176 can shield high-speed contacts 160. Low-speed contacts 140 can be located on first edge 132, while low-speed contacts 150 can be located on second edge 134.

Board-to-board receptacle 200 can include housing 210 having a recess 212 surrounding a raised central portion 220 and a raised outer portion 230. Board-to-board receptacle 200 can include ground shields 290 that can physically and electrically connect to ground shields 176 on board-to-board plug 100. High-speed contacts 260 can be located in recess 212, on a first edge 222 of raised central portion 220, and a first edge 232 of the raised outer portion 230. Ground contacts 270 can be located in recess 212, on the first edge 222 of raised central portion 220, and the first edge 232 of the raised outer portion 230. Low-speed contacts 240 can be located in recess 212, on the first edge 222 of raised central portion 220, and the first edge 232 of the raised outer portion 230. Low-speed contacts 250 can be located in recess 212, on a second edge 224 of raised central portion 220, and a second edge 234 of the raised outer portion 230.

When board-to-board plug 100 and board-to-board receptacle 200 are mated, raised central portion 220 can fit in central recess 112, raised outer portion 130 can fit in recesses 212, ground contacts 170 can connect to ground contacts 270, ground shields 176 can connect to ground shields 290, low-speed contacts 240 and 250 can connect to corresponding low-speed contacts 140 and 150, and high-speed contacts 260 can connect to high-speed contacts 160.

In these and other embodiments of the present invention, some or all of the conductive structures, such as the ground shields and various contacts, can be formed by stamping or other process. The housings, such as plug housing 110 and receptacle housing 210, can be insert molded around one or more of these conductive structures. Some or all of the remaining contacts and ground portions can be stamped and then fit to either plug housing 110 or receptacle housing 210. An example is shown in the following figure.

Figure 2A:
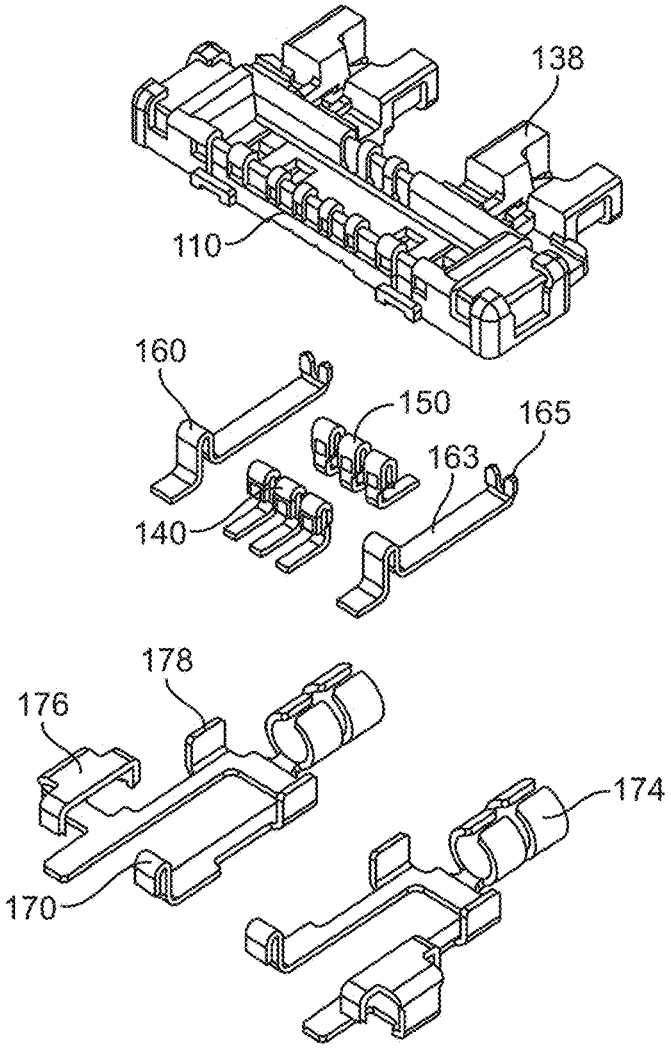
FIGS. 2A and 2B illustrates portions of the board-to-board plug of FIG. 1.
Figure 2B:
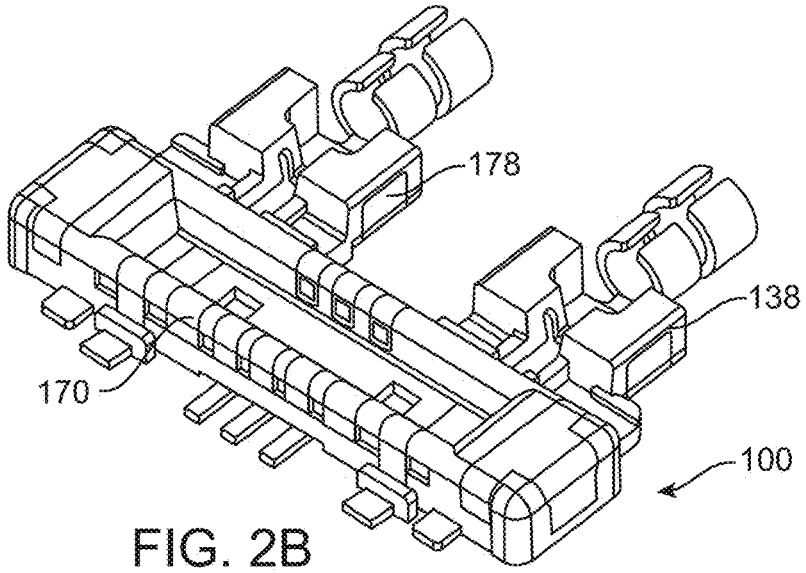

FIGS. 2A and 2B illustrate the board-to-board plug of FIG. 1. In FIG. 2A, ground contacts 170, ground shields 176, tabs 178, and crimping portions 174 can be formed and stamped as a single piece. Low-speed contacts 140 and 150 can be stamped. High-speed contacts 160 can also be stamped and can include a lateral support portion 163 having tabs 165 at an end. Tabs 165 can provide mechanical support and alignment for center conductors 192 of coaxial cables 190 (shown in FIG. 1.) Housing 110 can be molded. Housing 110 can include coaxial cable connection structures 138. As shown in FIG. 2B, tabs 178 of ground contacts 170 can provide shielding around a portion of coaxial cable connection structures 138 of board-to-board plug 100.

Figure 3:
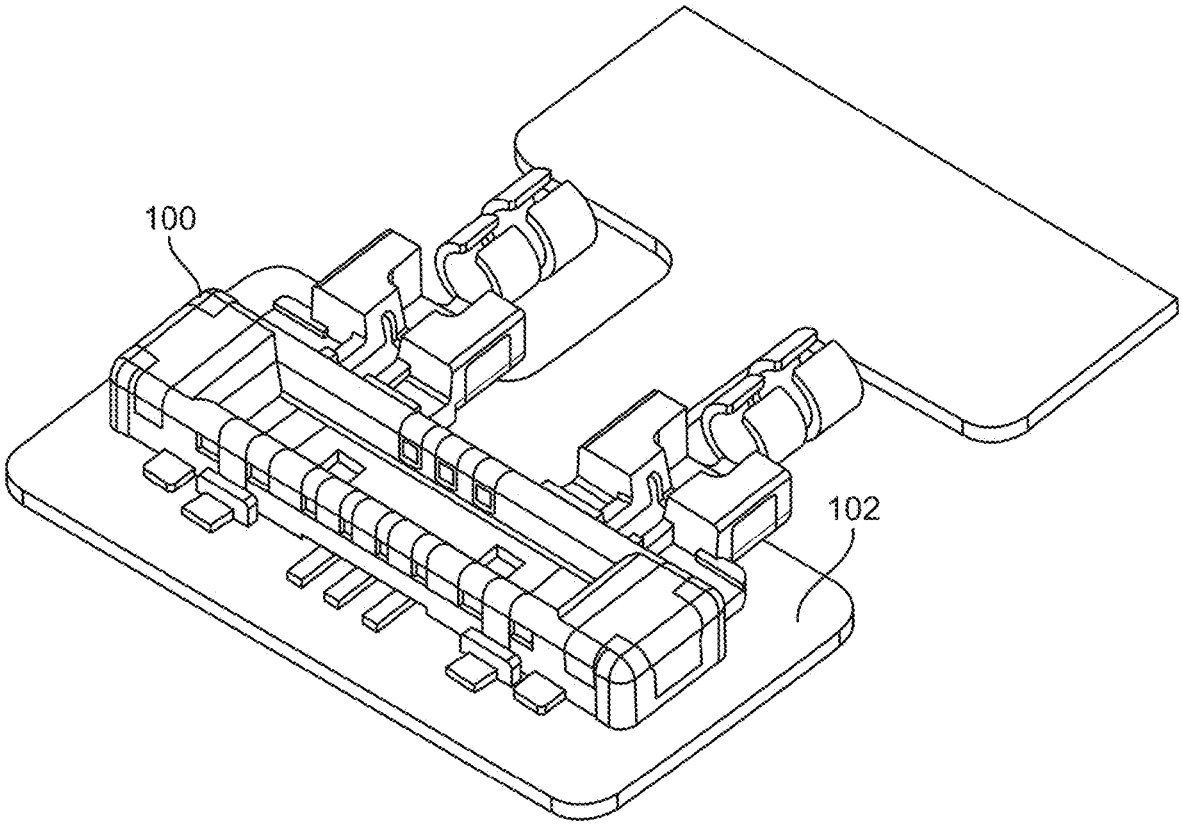
FIG. 3 illustrates the board-to-board plug of FIG. 1.

FIG. 3 illustrates the board-to-board plug of FIG. 1. In this example, coaxial cables 190 (shown in FIG. 1) have not yet been connected to board-to-board plug 100 on board 102.

Figure 4:
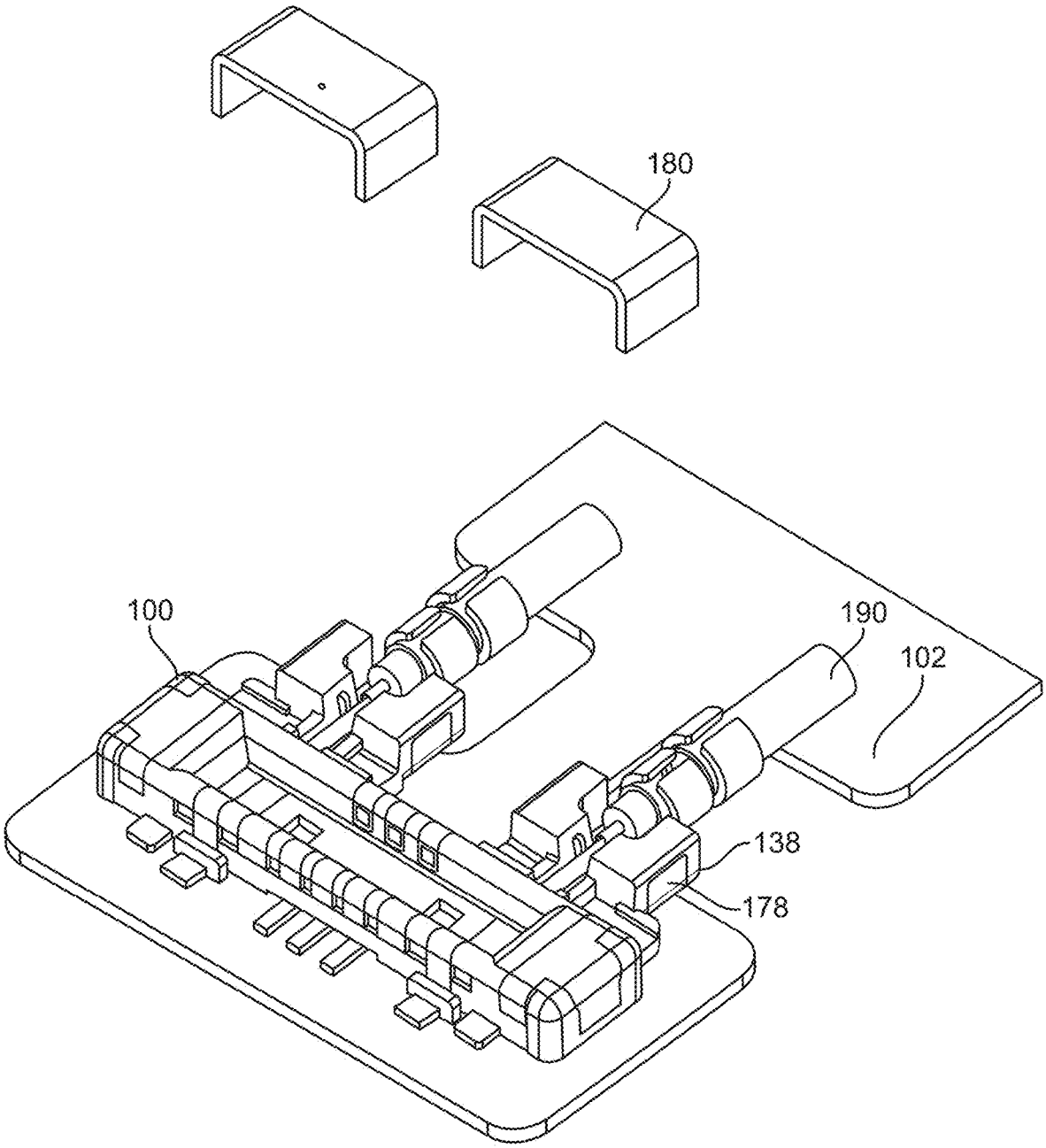
FIG. 4 illustrates the board-to-board plug of FIG. 1.

FIG. 4 illustrates the board-to-board plug of FIG. 1. In this example, coaxial cables 190 have been connected to board-to-board plug 100 on board 102. Ground shields 180 can be placed over coaxial cable connection structures 138. Ground shields 180 can be laser or spot welded to tabs 178.

Figure 5:
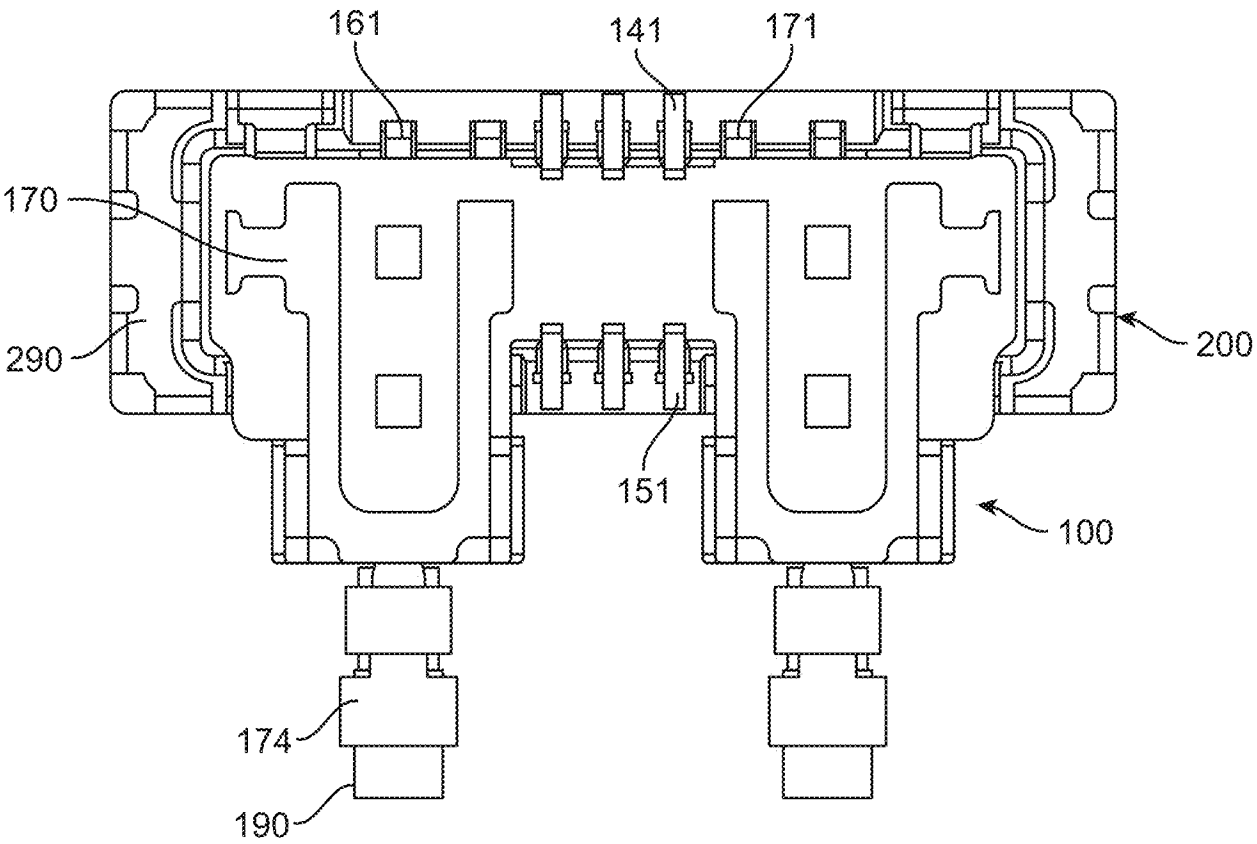
FIG. 5 illustrates an underside of the high-speed connector of FIG. 1.

FIG. 5 illustrates an underside of the high-speed connector of FIG. 1. In this example, board-to-board plug 100 can be inserted into board-to-board receptacle 200. Surface-mount contacting portions 141 and 151 for low-speed contacts 140 and 150 (shown in FIG. 1) can be exposed such that they can be soldered or otherwise connected to corresponding contacts on board 102 (shown in FIG. 1.) Coaxial cables 190 can be received by crimping portions 174 of ground contacts 170. Ground contacts 170 can include surface mount contacting portions 171. Ground shields 290 of board-to-board receptacle 200 can connect to ground shields 176 (shown in FIG. 1) of board-to-board plug 100. Surface-mount contacting portions 161 of high-speed contacts 160 (shown in FIG. 1) can be exposed such that they can be soldered or otherwise connected to corresponding contacts on board 102.

Figure 6:
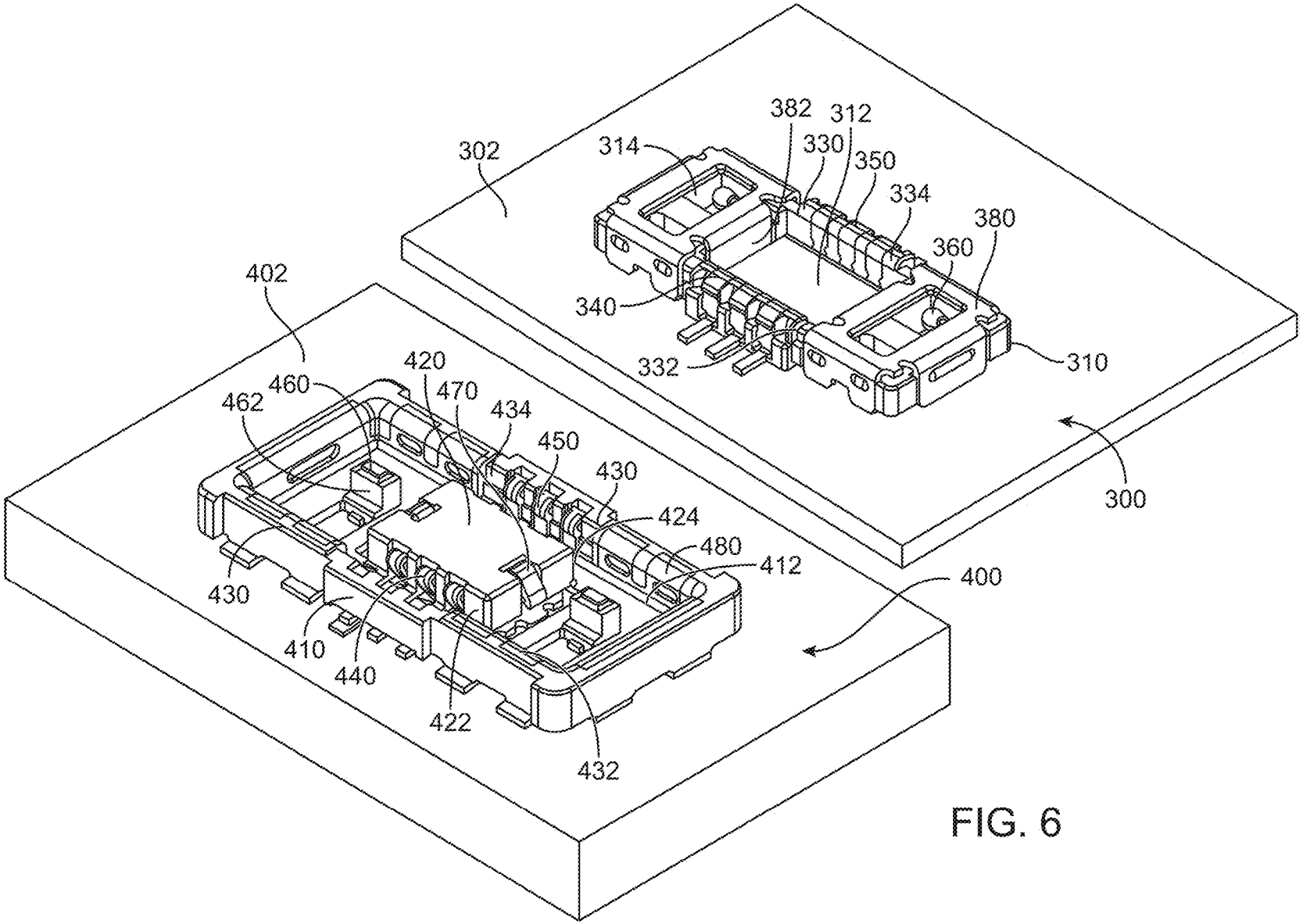
FIG. 6 illustrates another high-speed connector according to an embodiment of the present invention.

FIG. 6 illustrates another high-speed connector according to an embodiment of the present invention. This high-speed connector can include board-to-board receptacle 400 and board-to-board plug 300. Board-to-board plug 300 can be located on board 302, while board-to-board receptacle 400 can be located on board 402. Board 302 and board 402 can be printed circuit boards, flexible circuit boards or other appropriate substrates.

Instead of receiving signals on coaxial cables, board-to-board plug 300 can convey high-speed signals on traces (not shown) on board 302. These traces can be shielded by ground or other low-impedance lines (not shown) on either side in order to reduce coupling between the high-speed signals conveyed by the traces and other signals. The traces can terminate at high-speed contacts 360 in board-to-board plug 300.

Similarly, instead of receiving signals on coaxial cables, board-to-board receptacle 400 can convey high-speed signals on traces (not shown) on board 402. These traces can be shielded by ground or other low-impedance lines (not shown) on either side in order to reduce coupling between the high-speed signals conveyed by the traces and other signals. The traces can terminate at high-speed contacts 460 in board-to-board receptacle 400.

Board-to-board plug 300 can include housing 310. Housing 310 can include central recess 312 surrounded by raised outer portion 330. Housing 310 can also include recesses 314. High-speed contacts 360 can be located in recesses 314. Low-speed contacts 340 can be located on a first side 332 of raised outer portion 330. Low-speed contacts 350 can be located on a second side 334 of raised outer portion 330. Ground shields 380 can latterly surround high-speed contacts 360 on four sides, though grounds shields in this and other embodiments can surround high-speed contacts on fewer or more than four sides.

Board-to-board receptacle 400 can include recess 412 around raised central portion 420 and raised portions 462. Recess 412 can be surrounded by raised outer portion 430. High-speed contacts 460 can be located on raised portions 462. Low-speed contacts 440 can be located in recess 412, on a first edge 422 of raised central portion 420, and a first edge 432 of raised outer portion 430. Low-speed contacts 450 can be located in recess 412, on a second edge 424 of raised central portion 420, and a second edge 434 of raised outer portion 430. Ground contacts 470 can be located on raised central portion 420.

When board-to-board plug 300 and board-to-board receptacle 400 are mated, raised central portion 420 can fit in central recess 312, raised portions 462 can fit in recesses 314, ground contacts 470 can connect to inside surface 382 of ground shields 380, ground shields 480 can connect to ground shields 380, low-speed contacts 440 and 450 can connect to corresponding low-speed contacts 340 and 350, and high-speed contacts 460 can connect to high-speed contacts 360.

Figure 7A:
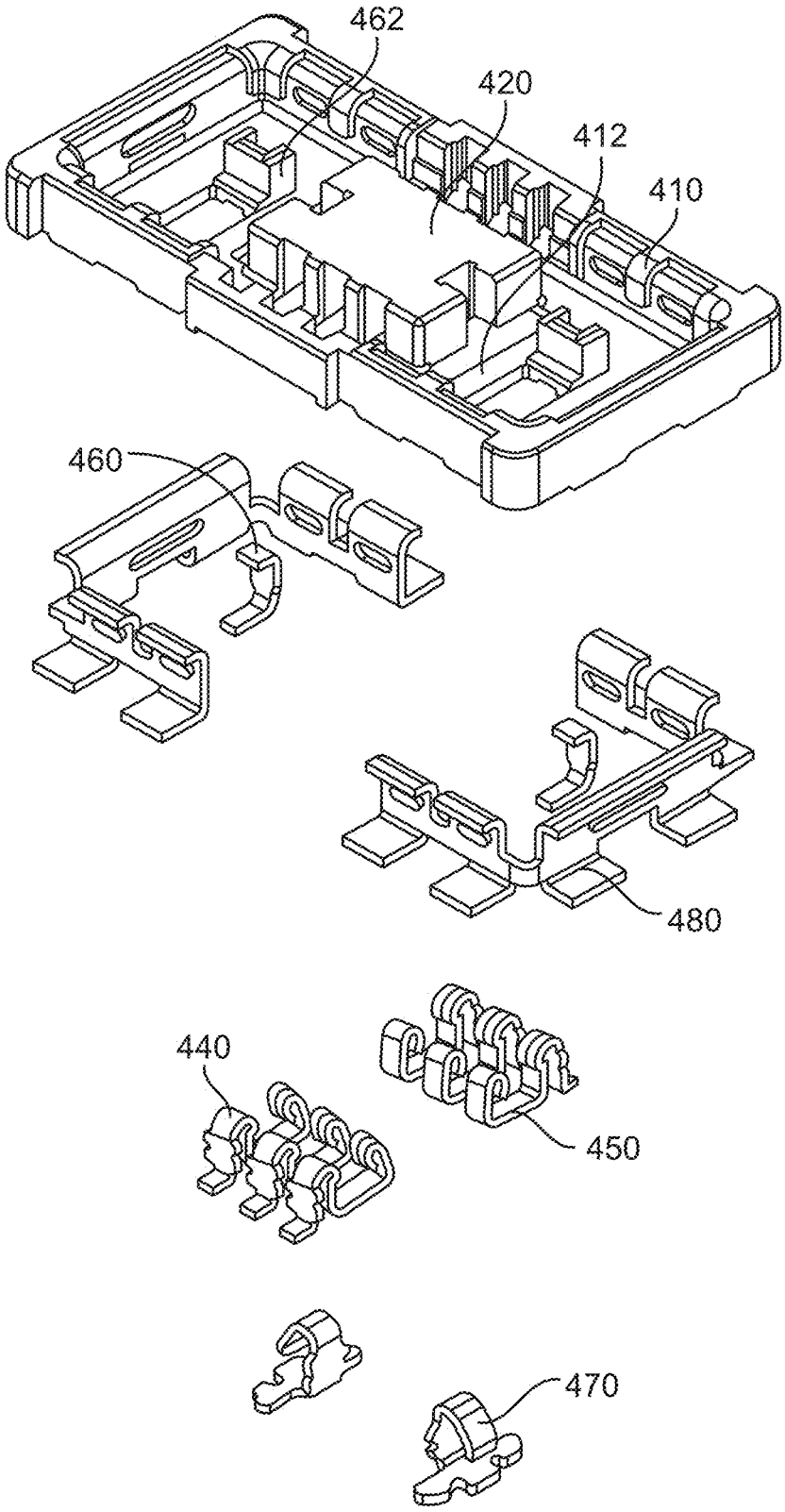
FIGS. 7A and 7B illustrate the board-to-board receptacle of FIG. 6.
Figure 7B:
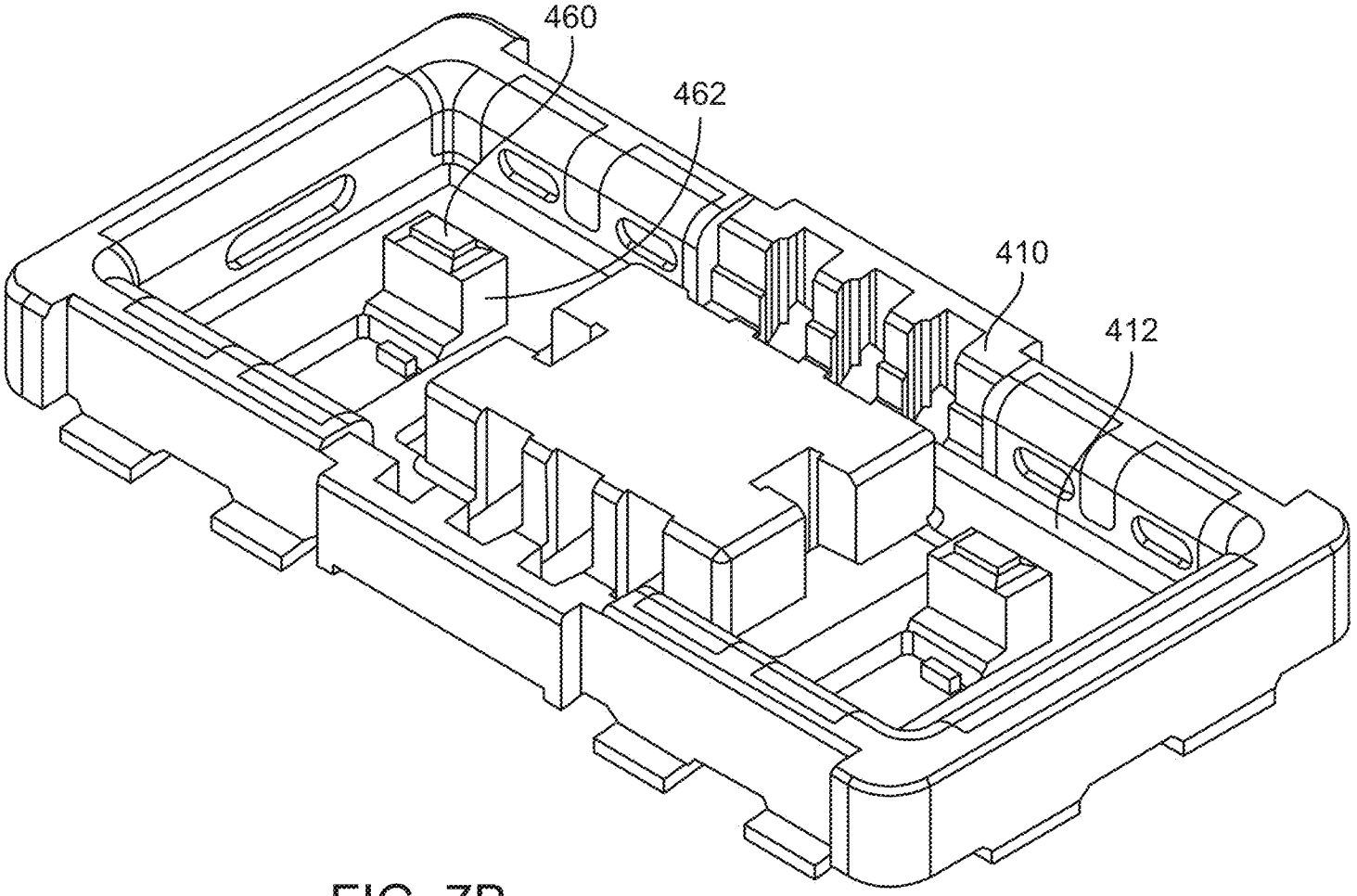

FIGS. 7A and 7B illustrate the board-to-board receptacle of FIG. 6. In FIG. 7A, housing 410 can include recess 412 around raised central portion 420 and raised portions 462. High-speed contacts 460, low-speed contacts 440, and low-speed contacts 450 can be stamped. Ground shields 480 and ground contacts 470 can also be included. As shown in FIG. 7B, high-speed contacts 460 can be located on raised portions 462 in recess 412 in housing 410.

Figure 8A:
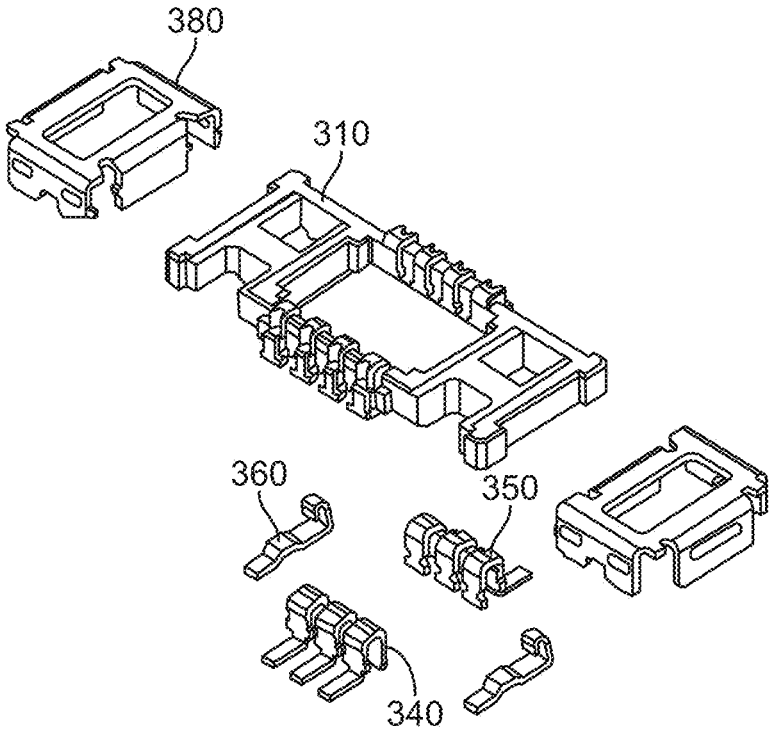
FIGS. 8A and 8B illustrate the board-to-board plug of FIG. 6.
Figure 8B:
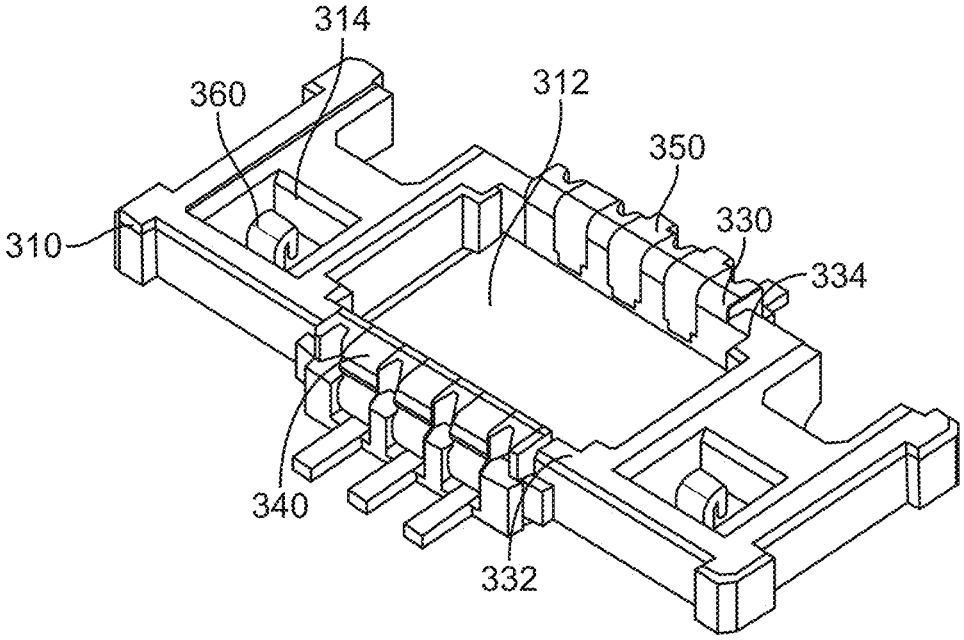

FIGS. 8A and 8B illustrate the board-to-board plug of FIG. 6. As shown in FIG. 8A, this board-to-board plug can include housing 310, high-speed contacts 360, and low-speed contacts 340 and 350. Ground shields 380 can surround high-speed contacts 360 on four lateral sides for shielding and isolation. As shown in FIG. 8B, low-speed contacts 340 can be located on a first side 332 of raised outer portion 330, while low-speed contacts 350 can be on a second side 334 of raised outer portion 330. Raised outer portion 330 can be defined by central recess 312. High-speed contacts 360 can be located in recesses 314 in housing 310.

Figure 9:
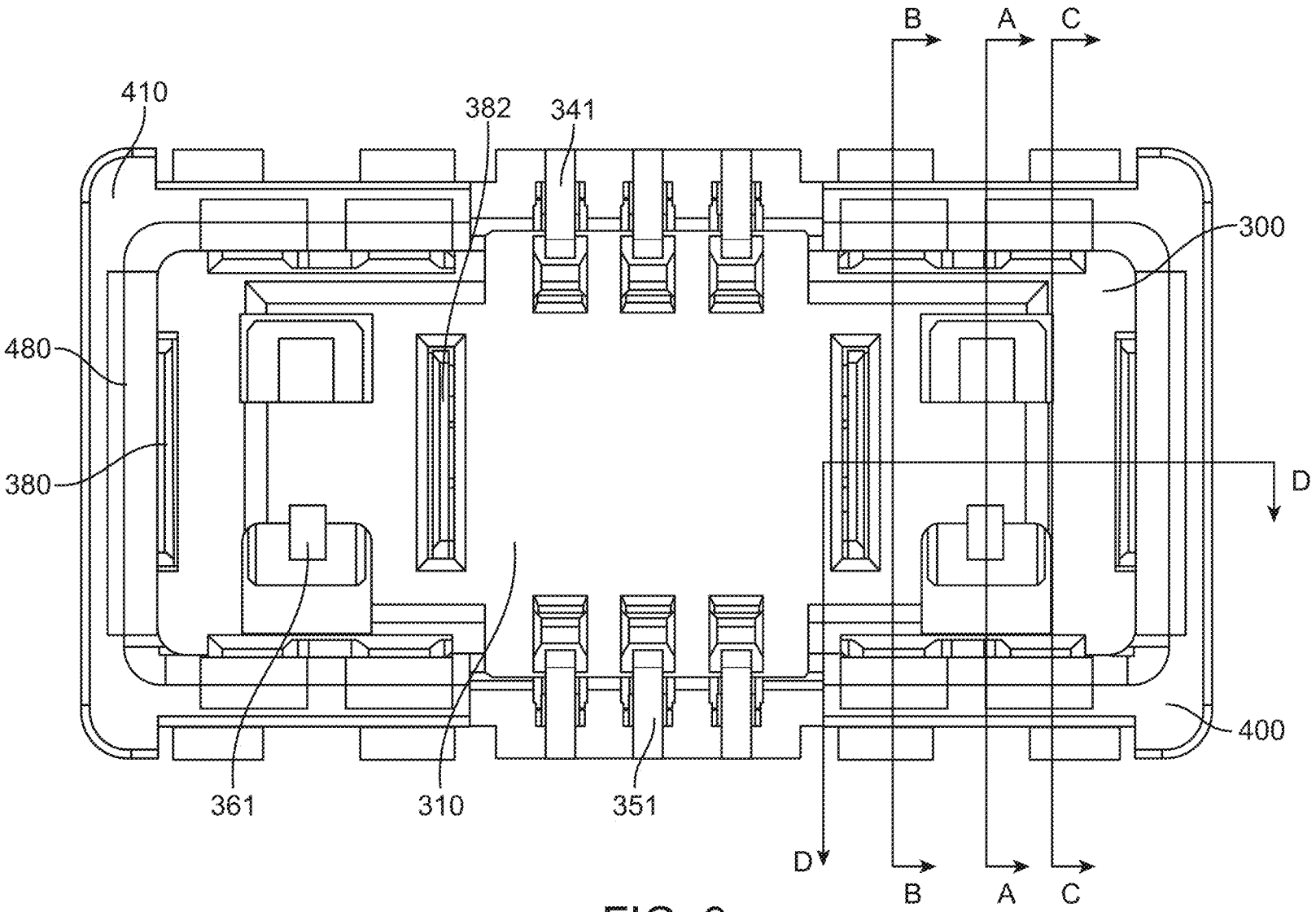
FIG. 9 illustrates a bottom view of the high-speed connector of FIG. 6.

FIG. 9 illustrates a bottom view of the high-speed connector of FIG. 6. In this example, surface-mount contacting portions 341 of low-speed contacts 340 (shown in FIG. 6), surface-mount contacting portions 351 of low-speed contacts 350 (shown in FIG. 6), and surface-mount contacting portions 361 of high-speed contacts 360 (shown in FIG. 6) can be located on a bottom surface of housing 310 and can be soldered or otherwise connected to a trace on board 302 (shown in FIG. 6.) Ground shield 380 of board-to-board plug 300 can connect to ground shield 480 on housing 410 of board-to-board receptacle 400. Ground shield 380 can also include inside surface 382.

Figure 10:
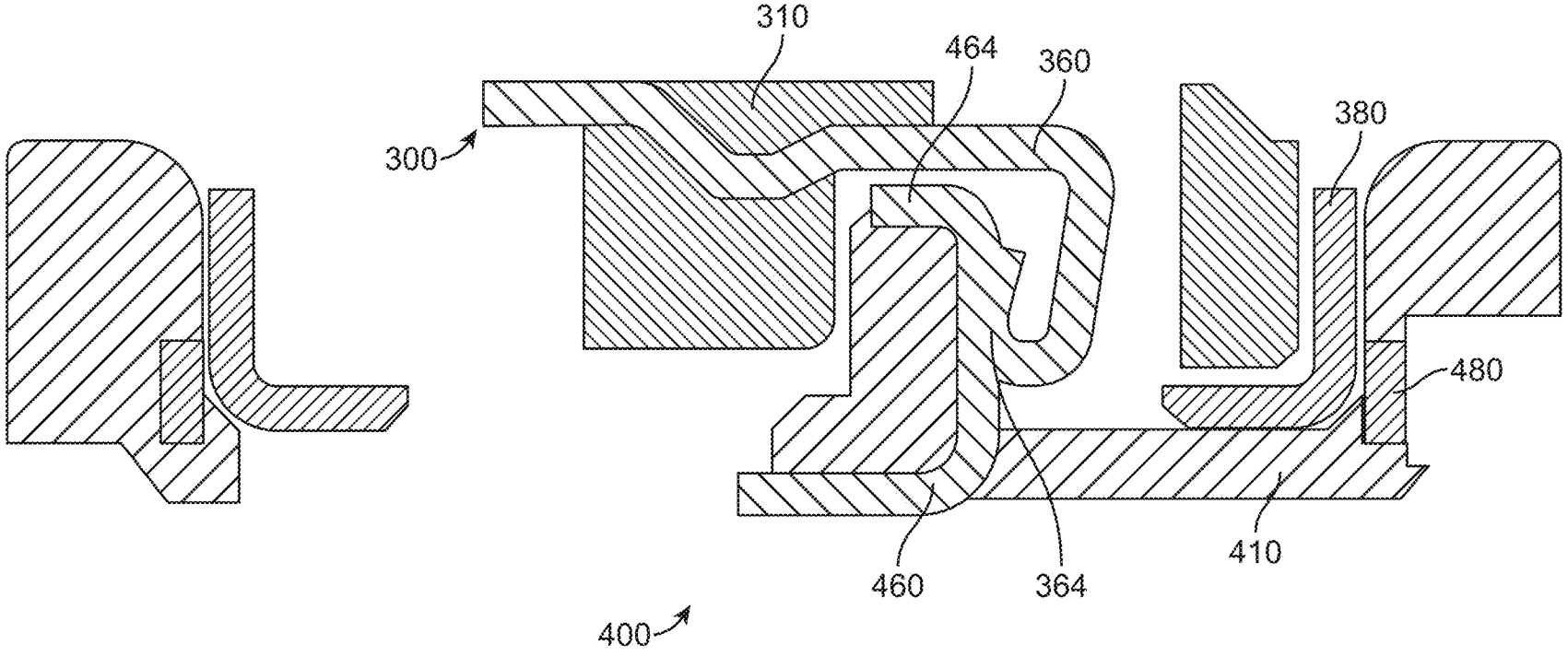
FIGS. 10-13 illustrates a cross-section views of the high-speed connector of FIG. 9.

FIG. 10 illustrates a cross-section view of the high-speed connector of FIG. 9 along cutline AA. This shows a cross section of housing 310 of board-to-board plug 300 and housing 410 of board-to-board receptacle 400. Again, ground shields 380 can electrically connect to ground shields 480. High-speed contact 460 can electrically connect to high-speed contact 360 at contacting point 364. A length of high-speed contacts 360 and high-speed contacts 460 beyond contacting point 364 can be limited. For example, section 464 can have a limited length. This limited length can help to reduce spurious frequency complements associated with high-speed contacts 360 and high-speed contacts 460.

Figure 11:
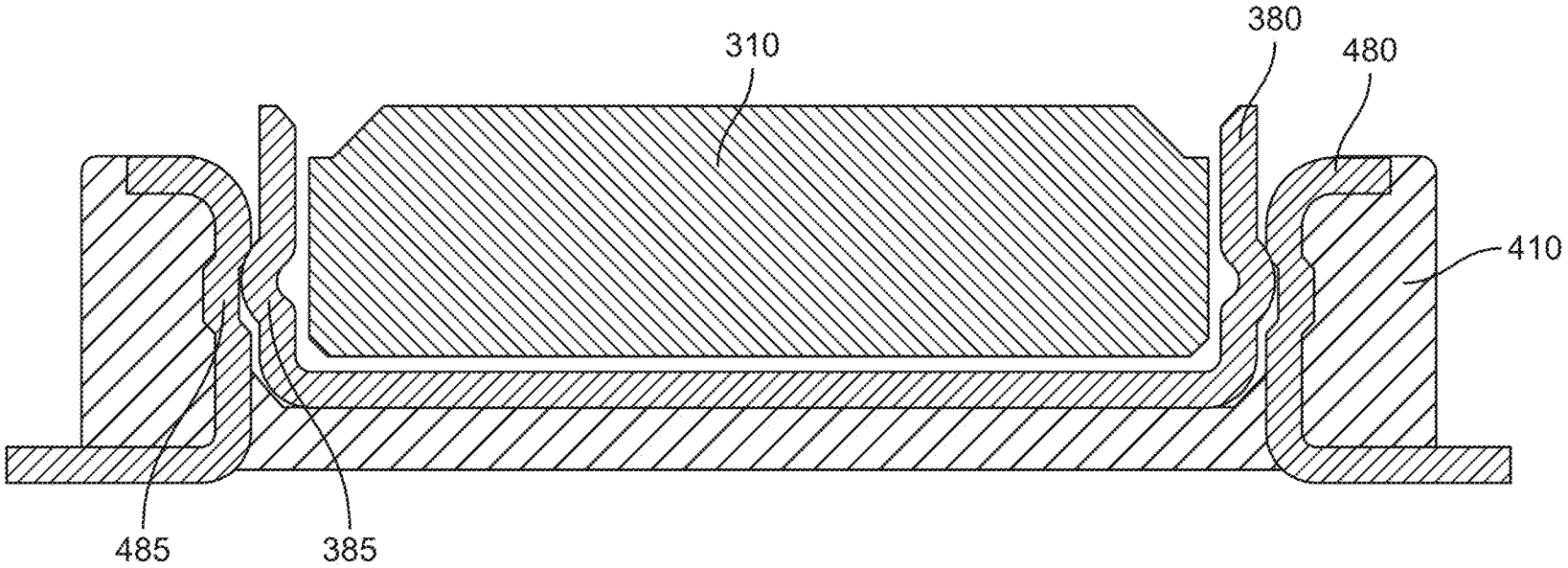

FIG. 11 illustrates a cross-section view of the high-speed connector of FIG. 9 along cutline BB. Again, ground shields 380 can be supported by housing 310, while ground shields 480 can be supported by housing 410. Protrusion 383 on ground shield 380 can mate with notch 485 on ground shields 480.

Figure 12:
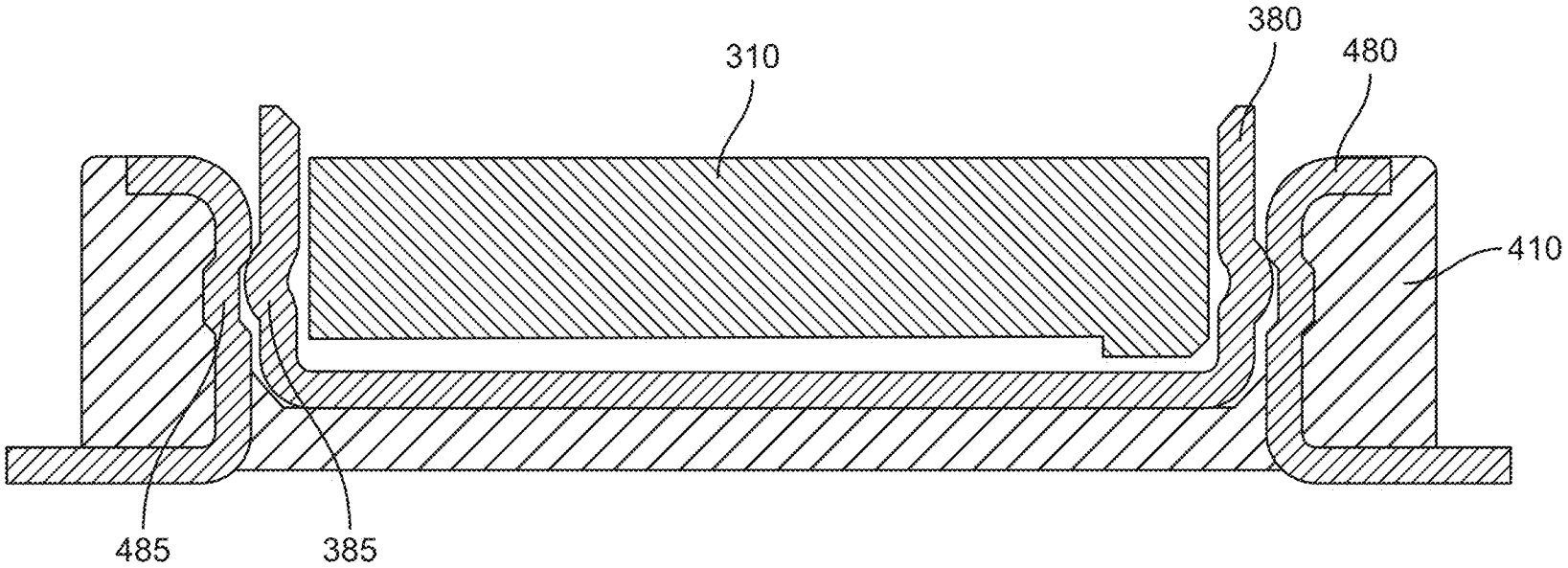

FIG. 12 illustrates a cross-section view of the high-speed connector of FIG. 9 along cutline CC. Again, ground shields 380 can be supported by housing 310, while ground shields 480 can be supported by housing 410. Protrusion 383 on ground shield 380 can mate with notch 485 on ground shields 480.

Figure 13:
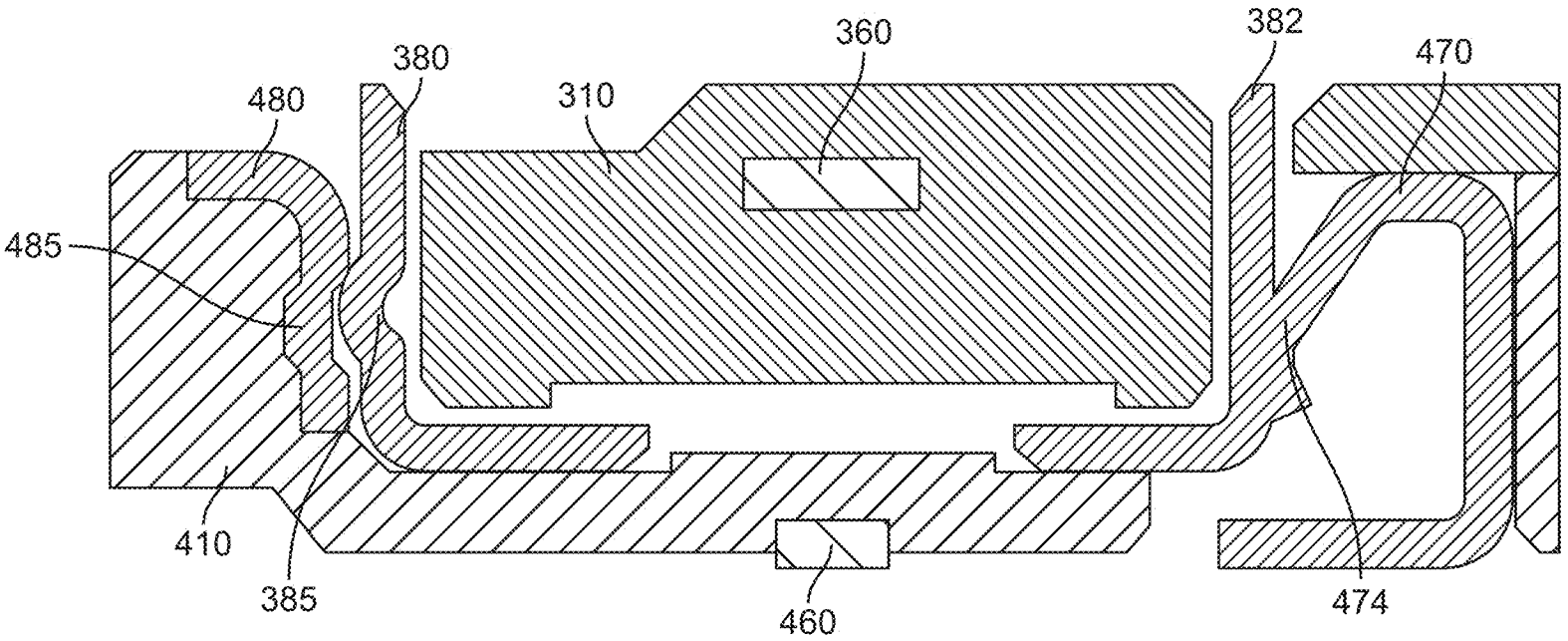

FIG. 13 illustrates a cross-section view of the high-speed connector of FIG. 9 along cutline DD. Again, ground shields 380 can be supported by housing 310, while ground shields 480 can be supported by housing 410. Protrusion 385 on ground shield 380 can mate with notch 485 on ground shields 480. High-speed contacts 360 and 460 can also be traversed. Ground contact 470 can connect to inside surface 382 of ground shield 380 at location 474.

Figure 14:
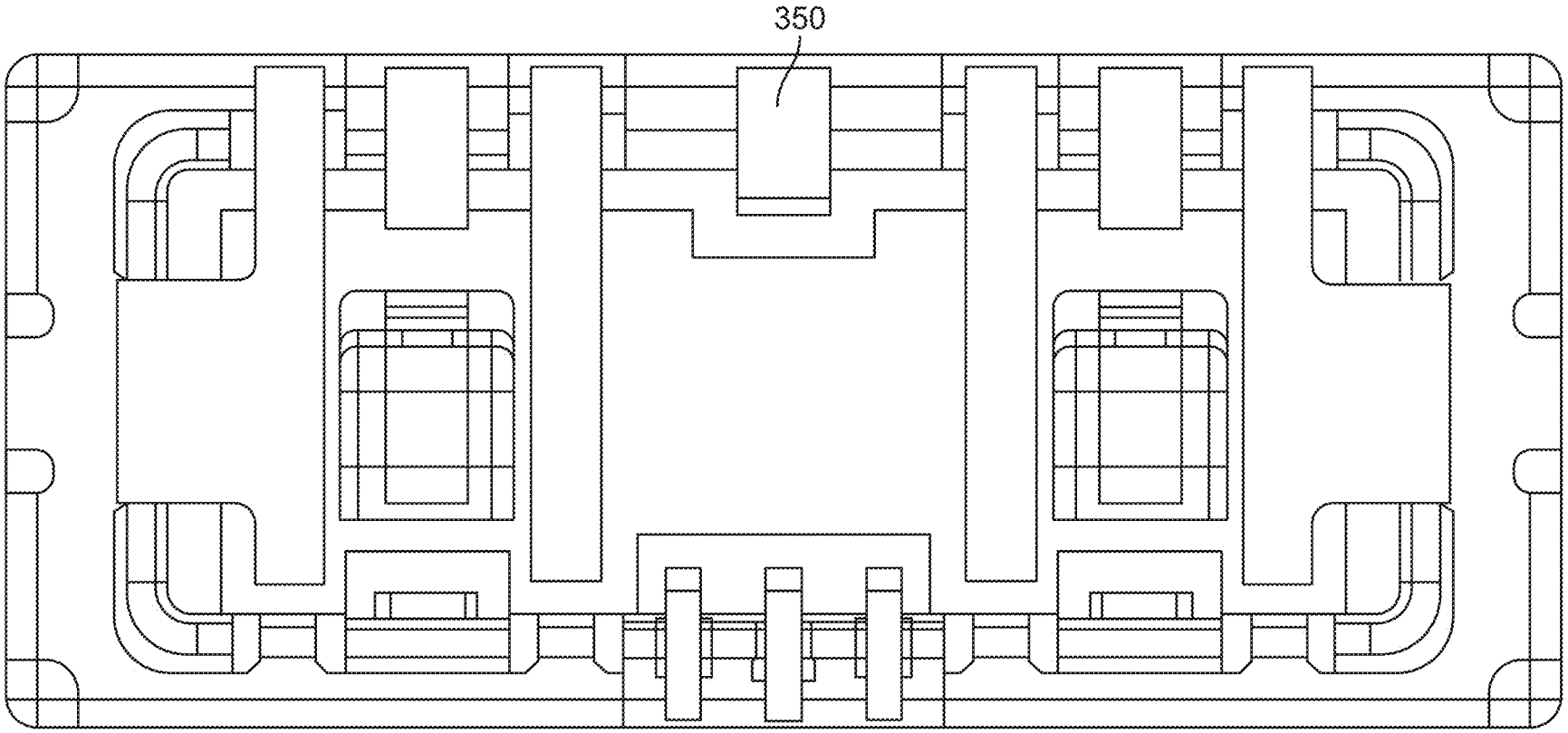
FIG. 14 illustrates an underside of another high-speed connector that is a variation on the high-speed connector of FIG. 9.

FIG. 14 illustrates an underside of another high-speed connector that is a variation on the high-speed connector of FIG. 9. In this example, low-speed contacts 350 can be replaced by a single contact 350. This single contact 350 can be a power supply or other type of contact.

In these and other embodiments of the present invention, a larger number of high-speed contacts might be needed in a high-speed connector. These high-speed connectors might or might not include a number of low-speed contacts. An example is shown in the following figure.

Figure 15:
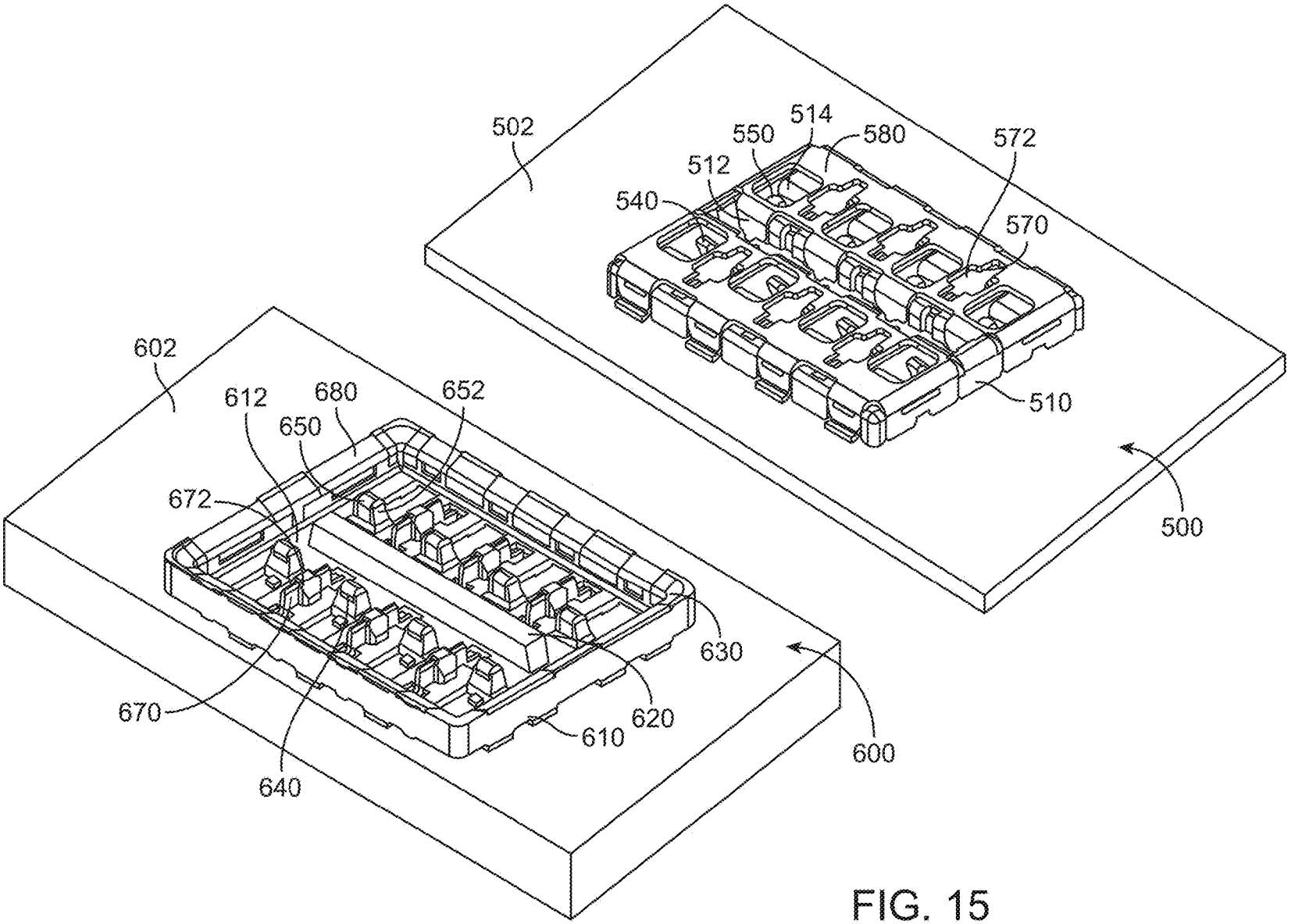
FIG. 15 illustrates another high-speed connector according to an embodiment of the present invention.

FIG. 15 illustrates another high-speed connector according to an embodiment of the present invention. This high-speed connector can include board-to-board plug 500 and board-to-board receptacle 600. Board-to-board plug 500 can be located on board 502, while board-to-board receptacle 600 can be located on board 602. Board 502 and board 602 can be printed circuit boards, flexible circuit boards or other appropriate substrates.

Board-to-board plug 500 can include housing 510. Housing 510 can include central recess 512. A first row of high-speed contacts 540 can each be located in a recess 514 in housing 510. A second row of high-speed contacts 550 can each be located in a recess 514 in housing 510. Ground shields 580 can provide shielding for high-speed contacts 540 and high-speed contacts 550. Ground contacts 570 can be located in recesses 572 in housing 510.

Board-to-board receptacle 600 can include housing 610. Housing 610 can include recess 612 defining a raised central portion 620. Raised central portion 620 can fit in central recess 512 in board-to-board plug 500. High-speed contacts 640 and high-speed contacts 650 can be located on raised portions 652. Ground contacts 670 can be located in raised portions 672. Ground shields 680 can be located on raised outer portion 630.

When board-to-board plug 500 is mated with board-to-board receptacle 600, raised central portion 620 can fit in central recess 512, raised portions 662 can fit in recesses 514, raised portions 672 can fit in recesses 572, high-speed contacts 640 can connect to high-speed contacts 540, high-speed contacts 650 can connect to high-speed contacts 550, ground contacts 670 can connect to ground contacts 570, and ground shields 680 can connect to ground shields 580.

As before, board-to-board plug 500 can convey high-speed signals on traces (not shown) on board 52. These traces can be shielded by ground or other low-impedance lines (not shown) on either side in order to reduce coupling between the high-speed signals conveyed by the traces and other signals. The traces can terminate at high-speed contacts 540 and 550 in board-to-board plug 500.

Similarly, instead of receiving signals on coaxial cables, board-to-board receptacle 600 can convey high-speed signals on traces (not shown) on board 602. These traces can be shielded by ground or other low-impedance lines (not shown) on either side in order to reduce coupling between the high-speed signals conveyed by the traces and other signals. The traces can terminate at high-speed contacts 460 in board-to-board receptacle 400.

Figure 16B:
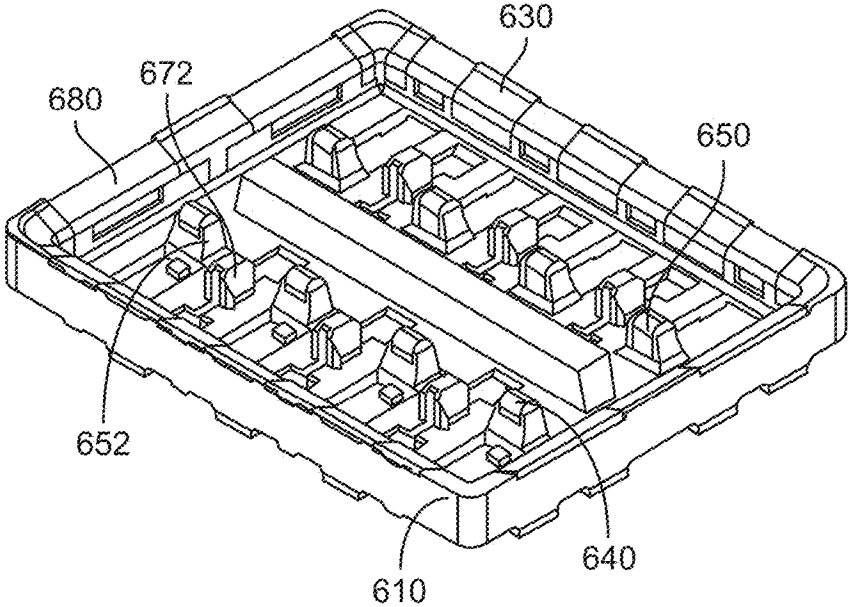
FIGS. 16A and 16B illustrate the board-to-board receptacle of FIG. 15.
Figure 16A:
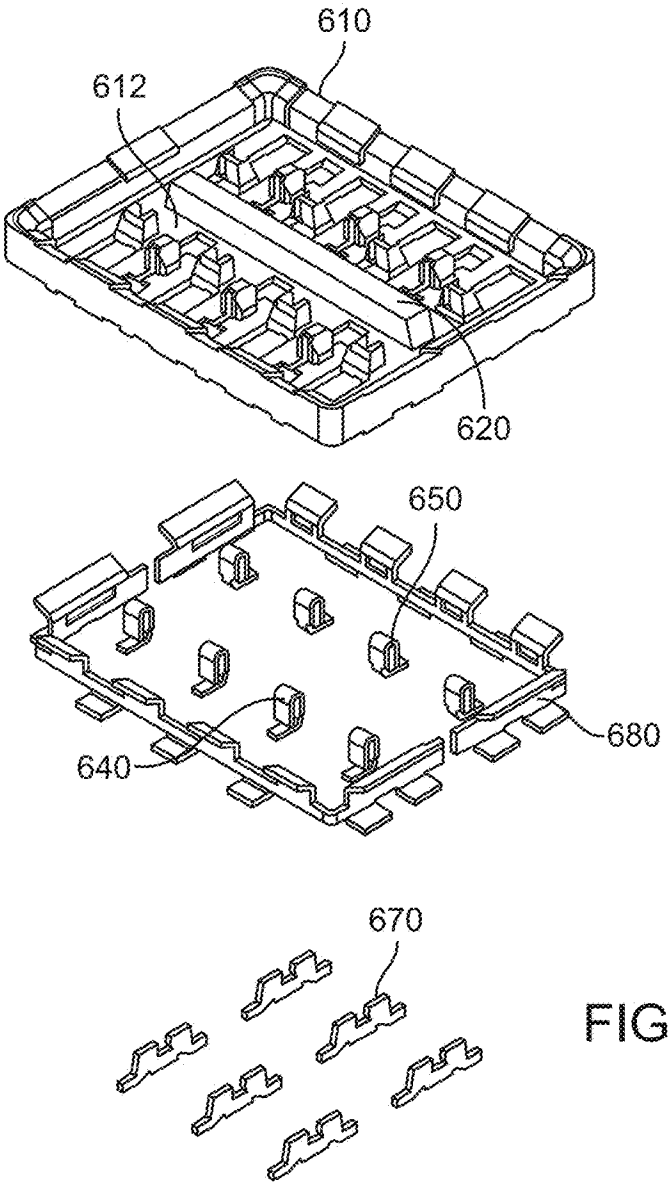

FIGS. 16A and 16B illustrate the board-to-board receptacle of FIG. 15. In FIG. 16A, housing 610 can include a recess 612 defining a raised central portion 620. High-speed contacts 640 and 650 and ground shields 680 can be stamped, as can ground contacts 670. As shown in FIG. 16B, high-speed contacts 640 and high-speed contacts 650 can be located on raised portions 652. Ground shield 680 can be located on raised outer portion 630 of housing 610. Raised portion 672 can accept ground contacts 670, shown in FIG. 16A.

Figure 17B:
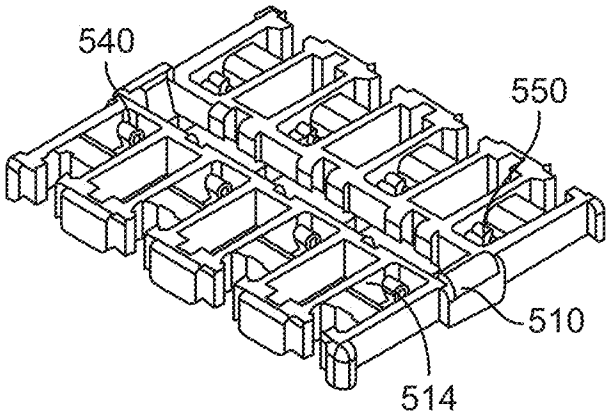
FIGS. 17A and 17B illustrate the board-to-board plug of FIG. 15.
Figure 17A:
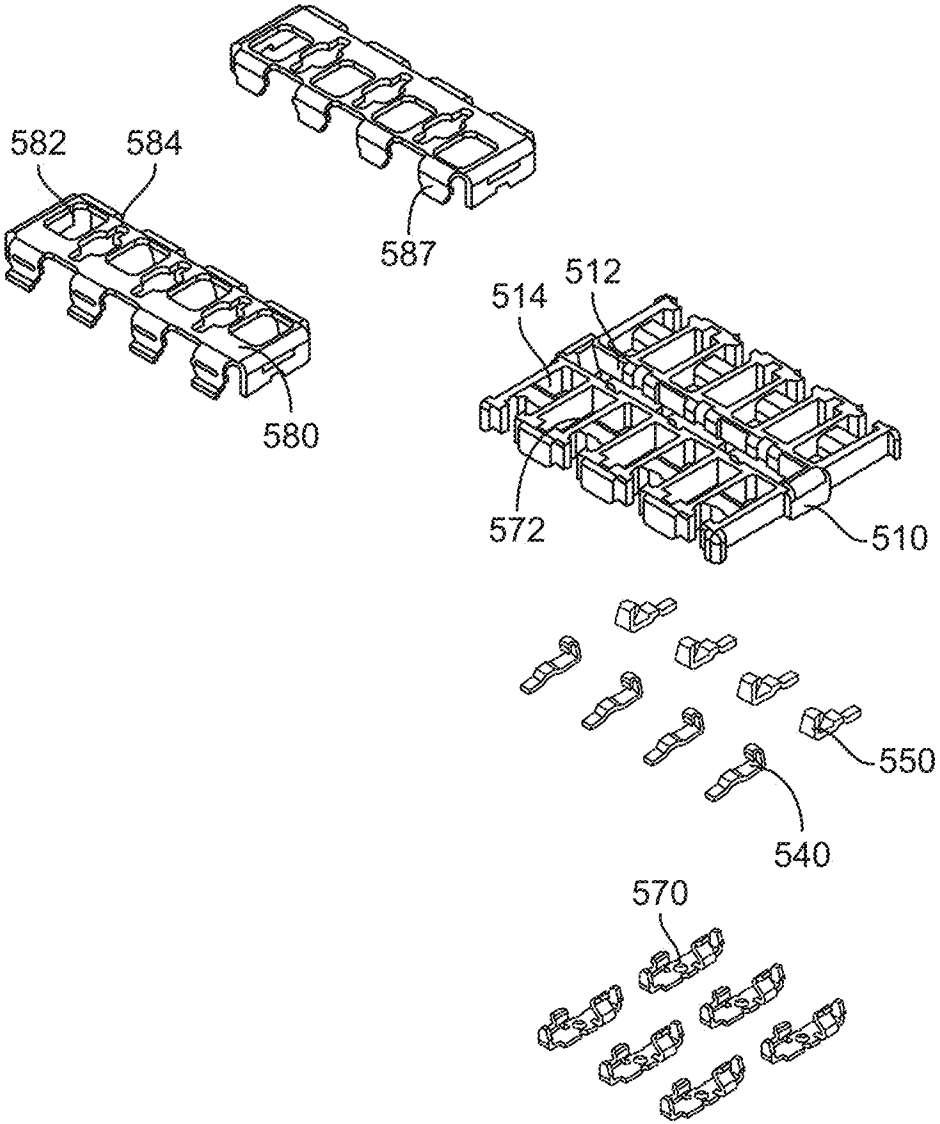

FIGS. 17A and 17B illustrate the board-to-board plug of FIG. 15. In FIG. 17A, high-speed contacts 540 and high-speed contacts 550 can be located in recesses 514 of housing 510. Ground contacts 570 can be located in recesses 572 in housing 510. Housing 510 can also include a central recess 512. Ground shields 580 can include openings 582 and 584 for access to recesses 514 and 572. Ground shields 580 can also include tabs 587, which can be inserted into housing 510. Again, high-speed contacts 540 and high-speed contacts 550 can be located in recesses 514 in housing 510, as shown in FIG. 17B.

Figure 18:
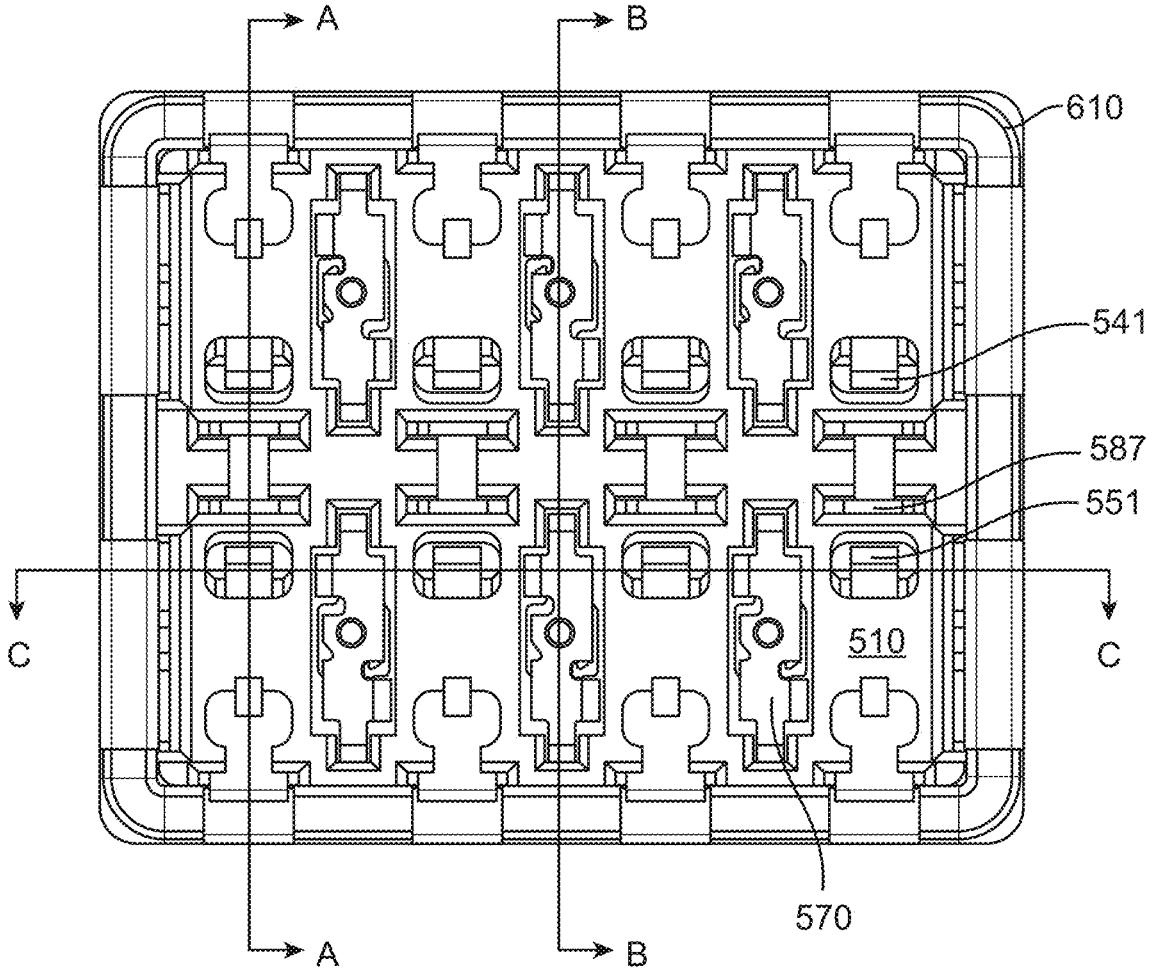
FIG. 18 illustrates an underside of the high-speed connector of FIG. 15.

FIG. 18 illustrates an underside of the high-speed connector of FIG. 15. Housing 510 can be located in housing 610, ground contacts 570, surface-mount contacting portions 541 of high-speed contacts 540, and surface-mount contacting portions 551 of high-speed contacts 550 (all shown in FIG. 15) can be located at a bottom surface of housing 510 and can be soldered or otherwise connected to corresponding contacts on board 502 (shown in FIG. 15.) Tabs 587 of ground shields 580 can be exposed on a bottom surface of housing 510 and can be connected contacts on board 502 (shown in FIG. 15.)

Figure 19:
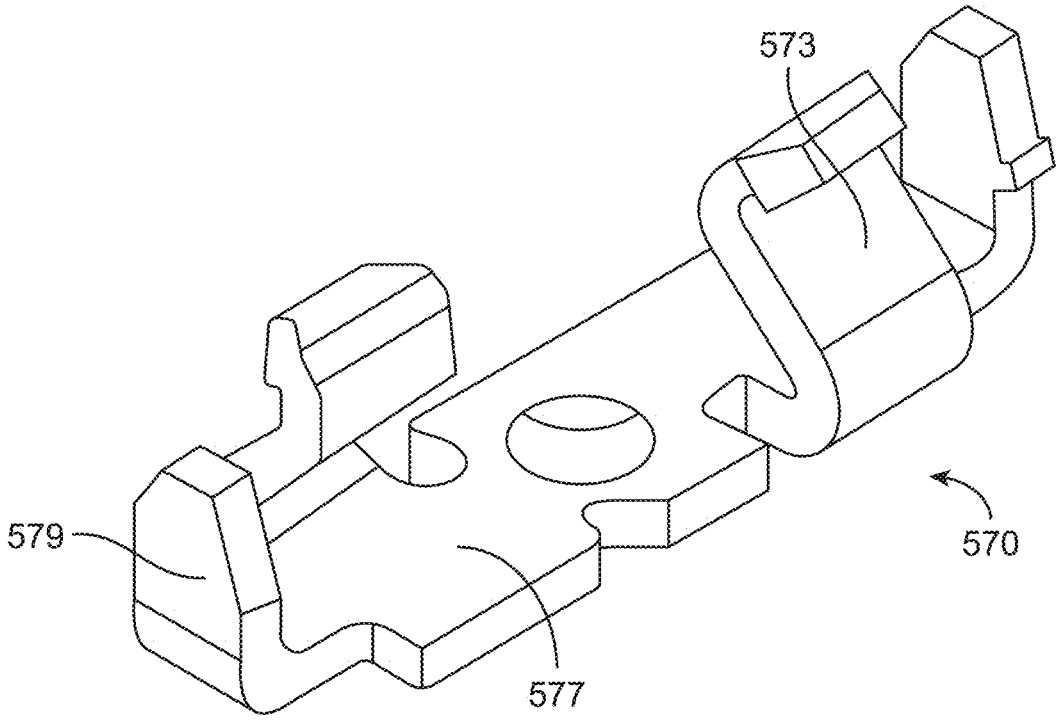
FIG. 19 illustrates a close-up view of a ground contact for the board-to-board plug of FIG. 15.

FIG. 19 illustrates a close-up view of a ground contact for a board-to-board plug according to an embodiment of the present invention. Ground contact 570 can include contacting arms 573 for engaging ground contacts 670 in board-to-board receptacle 600 (shown in FIG. 15.) Ground contacts 570 can also include a base portion 577 supporting barbs 579. Barbs 579 can be inserted into housing 510 of board-to-board plug 500 (shown in FIG. 15.)

Figure 20:
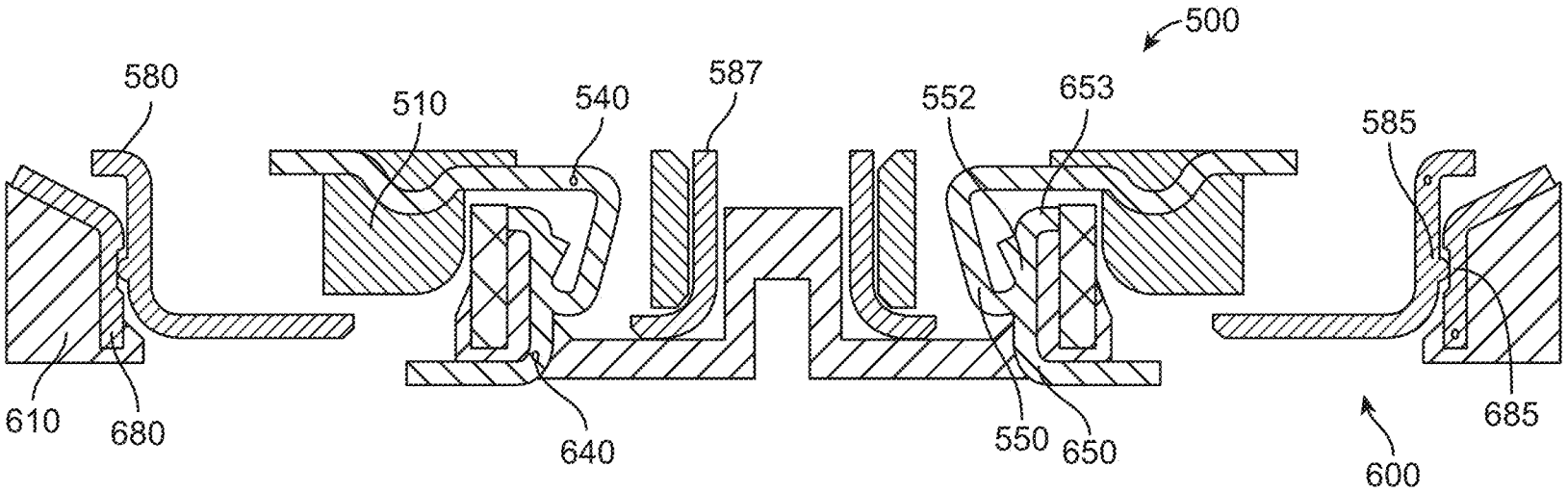
FIGS. 20-22 illustrates cross-section views of the high-speed connector of FIG. 18.

FIG. 20 illustrates a cross-section view of the high-speed connector of FIG. 18 along cutline AA. This shows a cross section of housing 510 of board-to-board plug 500 and housing 610 of board-to-board receptacle 600. Again, ground shields 580 can electrically connect to ground shields 680. Protrusion 585 on ground shield 580 can mate with notch 685 on ground shields 680. High-speed contact 650 can electrically connect to high-speed contact 550 at contacting point 552. A length of high-speed contacts 550 and high-speed contacts 650 beyond contacting point 552 can be limited. For example, section 653 can have a limited length. This limited length can help to reduce spurious frequency complements associated with high-speed contacts 640 and 650 and high-speed contacts 550 and 560.

Figure 21:
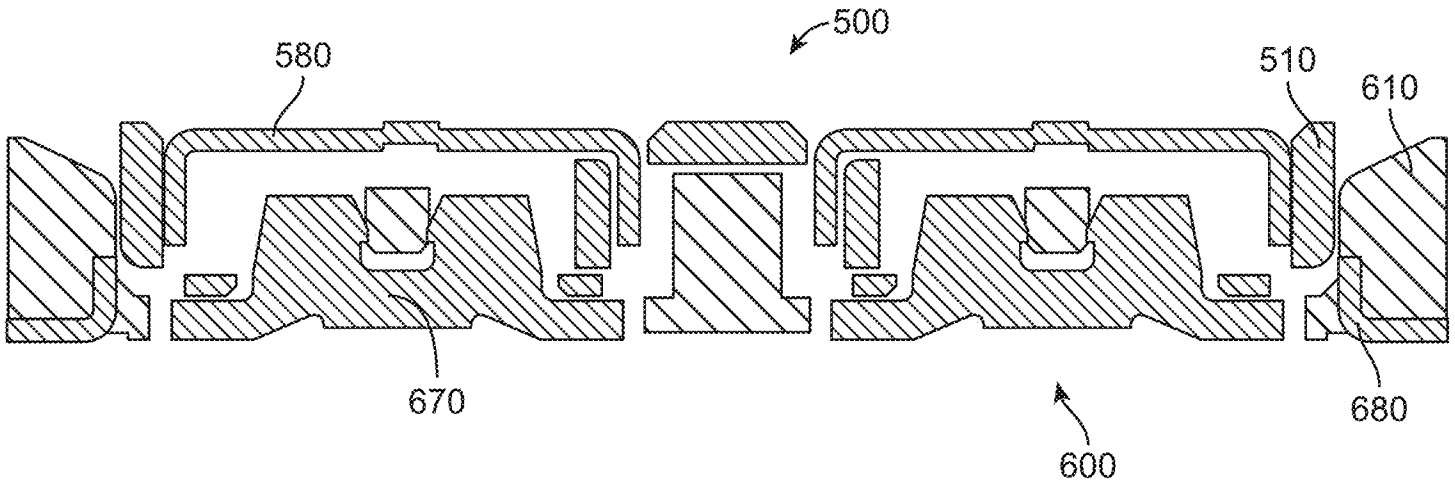

FIG. 21 illustrates a cross-section view of the high-speed connector of FIG. 18 along cutline BB. This shows a cross section of housing 510 of board-to-board plug 500 and housing 610 of board-to-board receptacle 600. Ground contacts 670, ground shields 580, and ground shields 680 are also shown.

Figure 22:
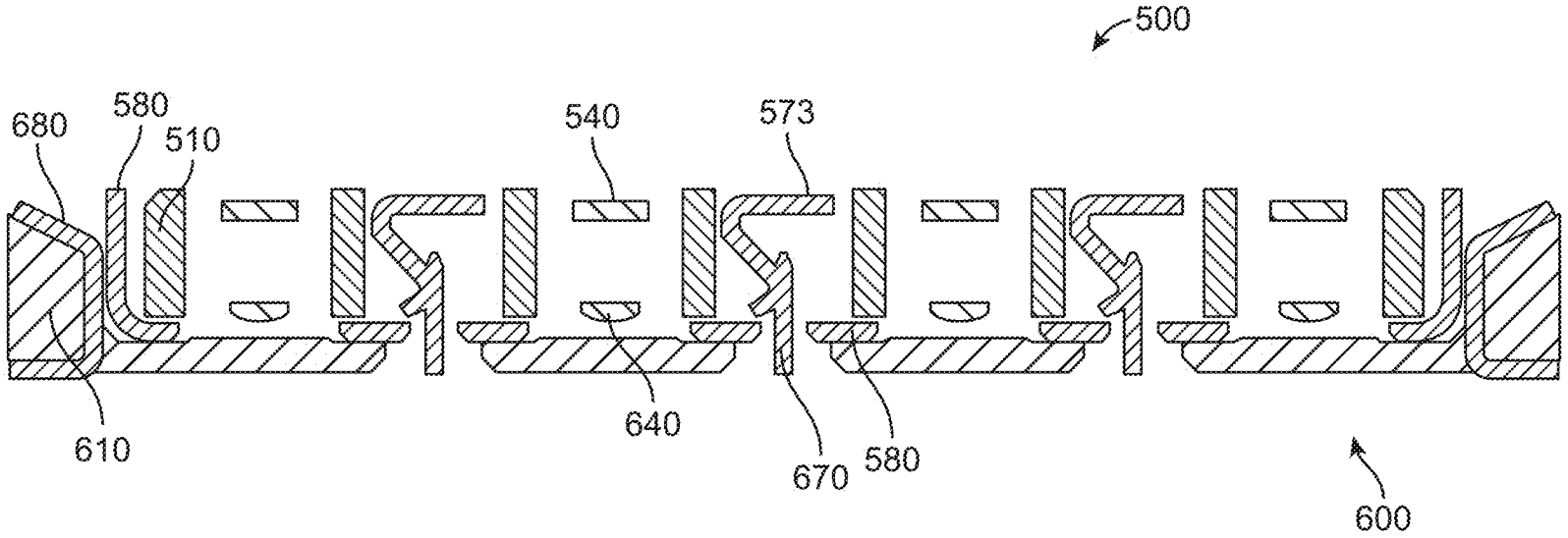

FIG. 22 illustrates a cross-section view of the high-speed connector of FIG. 18 along cutline CC. This shows a cross section of housing 510 of board-to-board plug 500 and housing 610 of board-to-board receptacle 600. Ground shields 680 can connect to ground shields 580. Contacting arms 573 can connect to ground contacts 670. High-speed contacts 540 and high-speed contacts 640 are also shown.

Figure 23:
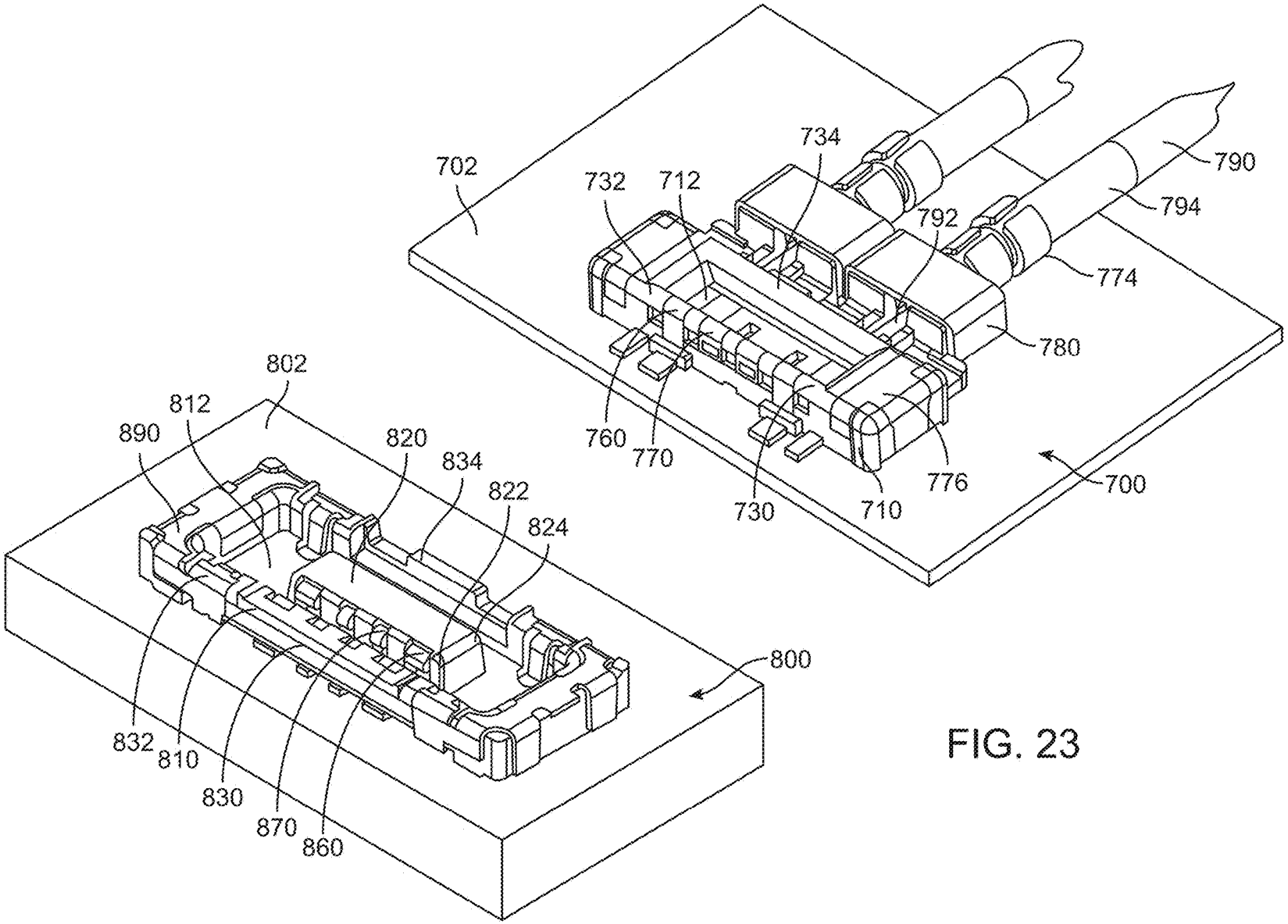
FIG. 23 illustrates another high-speed connector according to an embodiment of the present invention.

FIG. 23 illustrates a high-speed connector according to an embodiment of the present invention. This high-speed connector can include board-to-board receptacle 800 and board-to-board plug 700. Board-to-board receptacle 800 can be located on board 802 and board-to-board plug 700 can be located on board 702. Boards 802 and 702 can be printed circuit boards, flexible circuit boards, or other appropriate substrate. Board-to-board plug 700 can include connections for one or more coaxial cables 790. A center conductor 792 of coaxial cable 790 can connect to high-speed contacts 760. High-speed contacts 760 can be shielded by ground contacts 770 and ground shields 776. This shielding can protect signals conveyed by the coaxial cables 790 from interference by other signals. This shielding can also protect other signals from interference by signals conveyed by coaxial cables 790.

Coaxial cables 790 can be fixed to board-to-board plug 700 by crimping portions 774. Crimping portions 774 can be tightened around coaxial cable 790 to hold coaxial cable 790 in place. Crimping portions 774 can also physically and electrically connect to a shielding 794 or braided layer of coaxial cable 790. Center conductors 792 of coaxial cables 790 can be shielded by ground shields 780 and can connect to high-speed contacts 760. High-speed contacts 760 can be supported by housing 710. Housing 710 can include a central recess 712 surrounded by raised outer portion 730. Raised outer portion 730 can include a first edge 732 and a second edge 734. Ground contacts 770 and ground shields 776 can shield high-speed contacts 760.

Board-to-board receptacle 800 can include housing 810 having a recess 812 surrounding a raised central portion 820 and a raised outer portion 830. Board-to-board receptacle 800 can include ground shields 890 that can physically and electrically connect to ground shields 776 on board-to-board plug 700. High-speed contacts 860 can be located in recess 812, on a first edge 822 of raised central portion 820, and a first edge 832 of the raised outer portion 830. Ground contacts 870 can be located in recess 812, on the first edge 822 of raised central portion 820, and the first edge 832 of the raised outer portion 830.

When board-to-board plug 700 and board-to-board receptacle 800 are mated, raised central portion 820 can fit in central recess 712, raised outer portion 730 can fit in recesses 812, ground contacts 770 can connect to ground contacts 870, ground shields 776 can connect to ground shields 890, and high-speed contacts 860 can connect to high-speed contacts 760.

Many of the structures in board-to-board plug 700 and board-to-board receptacle 800 can be the same or similar as structures in the other examples, such as the example in FIG. 1. Housing 710 can be the same or similar to housing 110. High-speed contacts 760 can be the same or similar to high-speed contacts 160. Ground contacts 770 can be the same or similar to ground contacts 170. Ground shields 776 can be the same or similar to ground shields 176. Ground shields 780 can be the same or similar to ground shields 180. Housing 810 can be the same or similar to housing 210. High-speed contacts 860 can be the same or similar to high-speed contacts 260. Ground contacts 870 can be the same or similar to ground contacts 270. Ground shields 890 can be the same or similar to ground shields 290.

In these and other embodiments of the present invention, some or all of the conductive structures, such as the ground shields and various contacts, can be formed by stamping or other process. The housings, such as plug housing 710 and receptacle housing 810, can be insert molded around one or more of these conductive structures. Some or all of the remaining contacts and ground portions can be stamped and then fit to either plug housing 710 or receptacle housing 810.

While embodiments of the present invention are well-suited to providing high-speed connections for coaxial cables, these and other embodiments of the present invention can provide high-speed connectors that include board-to-board plugs and receptacles for one or more other types of cables, such as twin-axial, twisted pair, shielded twisted pair, fiber optic, single conductor, or other types of cables and combinations of these and coaxial cables.

In various embodiments of the present invention, contacts, ground contacts, ground shields, and other conductive portions of a high-speed connector can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions can be formed using injection or other molding, 3-D printing, machining, or other manufacturing process. The nonconductive portions can be formed of silicon or silicone, rubber, hard rubber, plastic, nylon, liquid-crystal polymers (LCPs), or other nonconductive material or combination of materials.

Embodiments of the present invention can provide high-speed connectors that can be located in various types of devices, such as portable computing devices, tablet computers, desktop computers, laptops, all-in-one computers, cell phones, wearable-computing devices, storage devices, portable media players, navigation systems, monitors, power supplies, adapters, remote control devices, chargers, and other devices. These high-speed connectors can provide pathways for signals that are compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A high-speed connector comprising:

a board-to-board receptacle comprising:

a housing including a recess forming a raised central portion and a raised outer portion;

a first plurality of low-speed contacts in the recess on a first edge of the raised central portion and a first edge of the raised outer portion;

a second plurality of low-speed contacts in the recess and on a second edge of the raised central portion and a second edge of the raised outer portion;

a plurality of high-speed contacts in the recess and on the first edge of the raised central portion and the first edge of the raised outer portion; and a plurality of ground contacts in the recess and on the first edge of the raised central portion and the first edge of the raised outer portion; and a board-to-board plug comprising:

a housing including a raised outer portion around a recess, where the raised outer portion is arranged to fit in the recess of the board-to-board receptacle and the recess is arranged to accept the raised central portion of the board-to-board receptacle;

a first plurality of low-speed contacts on a first side of the raised outer portion;

a second plurality of low-speed contacts on a second side of the raised outer portion;

a plurality of high-speed contacts on the first side of the raised outer portion; and a plurality of ground contacts on the first side of the raised outer portion.

2. The high-speed connector of claim 1 wherein each of the plurality of high-speed contacts of the board-to-board plug comprises a lateral portion extending from the first side of the raised outer portion to under the second side of the raised outer portion.

3. The high-speed connector of claim 2 wherein each of the plurality of high-speed contacts of the board-to-board plug further comprises two right-angled tabs on the lateral portion.

4. The high-speed connector of claim 3 wherein for each of the plurality of high-speed contacts of the board-to-board plug, the right-angled tabs position a central conductor of a coaxial cable onto the lateral portion.

5. The high-speed connector of claim 4 wherein each of the plurality of ground contacts of the board-to-board plug further comprises a crimping portion to be crimped to a ground shield of the coaxial cable.

6. The high-speed connector of claim 5 wherein each of the plurality of ground contacts of the board-to-board plug further comprises and end portion to form a ground connection at an end of the board-to-board plug.

7. The high-speed connector of claim 6 wherein the board-to-board receptacle further comprises a first ground connection at a first end and a second ground connection at a second end, each to form a ground path with a corresponding ground connection on the board-to-board plug.

8. A high-speed connector comprising:

a board-to-board receptacle comprising:

a housing including a recess forming a first raised central portion, a second raised portion, a third raised portion, and a raised outer portion;

a first plurality of low-speed contacts in the recess on a first edge of the first raised central portion and a first edge of the raised outer portion;

a second plurality of low-speed contacts in the recess and on a second edge of the first raised central portion and a second edge of the raised outer portion;

a first high-speed contact on the second raised portion;

a second high-speed contact on the third raised portion; and a plurality of ground contacts in the recess and on the first raised central portion; and a board-to-board plug comprising:

a housing including a raised outer portion around a first recess, a second recess, and a third recess, where the raised outer portion is arranged to fit in the recess of the board-to-board receptacle, the first recess is arranged to accept the first raised central portion of the board-to-board receptacle, the second recess is arranged to accept the second raised portion of the board-to-board receptacle, and the third recess is arranged to accept the third raised portion of the board-to-board receptacle;

a first plurality of low-speed contacts on a first side of the raised outer portion;

a second plurality of low-speed contacts on a second side of the raised outer portion;

a first high-speed contact in the second recess;

a second high-speed contact in the third recess; and a plurality of ground contacts in the first recess.

9. The high-speed connector of claim 8 wherein the plurality of ground contacts in the recess and on the first raised central portion of the board-to-board receptacle comprises a first ground contact in the recess and between the first high-speed contact and the first raised central portion and a second ground contact in the recess and between the second high-speed contact and the first raised central portion.

10. The high-speed connector of claim 9 wherein the plurality of ground contacts in the recess and on the first raised central portion of the board-to-board receptacle further comprises a third ground contact on three sides of the recess and around the first high-speed contact, and a fourth ground contact on three sides of the recess and around the second high-speed contact.

11. The high-speed connector of claim 8 wherein the plurality of ground contacts in the recess and on the first raised central portion of the board-to-board receptacle shields the first high-speed contact and the second high-speed contact.

12. The high-speed connector of claim 8 wherein the low-speed contacts, high-speed contacts, and ground contacts are formed by stamping.

13. The high-speed connector of claim 12 wherein the housing for the board-to-board receptacle is insert molded around the low-speed contacts, high-speed contacts, and ground contacts.

14. The high-speed connector of claim 13 wherein the housing for the board-to-board plug is insert molded around the low-speed contacts and high-speed contacts, and the ground contacts are inserted into the housing.

15. A high-speed connector comprising:

a board-to-board receptacle comprising:

a housing including a recess forming a first raised central portion, a second plurality of raised portions, a third plurality of raised portions, and a raised outer portion;

a first plurality of high-speed contacts, each in the recess on a first side of the first raised central portion and on a corresponding one of the plurality of second raised portions;

a second plurality of high-speed contacts, each in the recess on a second side of the first raised central portion and on a corresponding one of the plurality of third raised portions;

a first plurality of ground contacts in the recess, each between adjacent contacts in the first plurality of high-speed contacts; and a second plurality of ground contacts in the recess, each between adjacent contacts in the second plurality of high-speed contacts; and a board-to-board plug comprising:

a housing including a first central recess, a second plurality of recesses on a first side of the first central recess, and a third plurality of recesses on a second side of the first central recess, where the first central recess is arranged to accept the first raised central portion of the board-to-board receptacle, the second plurality of recesses are arranged to accept a corresponding one of the plurality of second raised portions, and the third plurality of recess are arranged to accept a corresponding one of the third plurality of raised portions;

a first plurality of high-speed contacts each in a corresponding one of the second plurality of recesses;

a second plurality of high-speed contacts each in a corresponding one of the third plurality of recesses;

a first plurality of ground contacts, each between adjacent contacts in the first plurality of high-speed contacts; and a second plurality of ground contacts, each between adjacent contacts in the second plurality of high-speed contacts.

16. The high-speed connector of claim 15 wherein the housing for the board-to-board plug further comprises:

a fourth plurality of recesses, each between adjacent ones of the second plurality of recesses; and a fifth plurality of recesses, each between adjacent ones of the third plurality of recesses.

17. The high-speed connector of claim 16 wherein in the board-to-board plug, each of the first plurality of ground contacts are located in a corresponding one of the fourth plurality of recesses and each of the second plurality of ground contacts are located in a corresponding one of the fifth plurality of recesses.

18. The high-speed connector of claim 17 wherein the board-to-board plug further comprises a first shield having openings for the second plurality of recesses and the fourth plurality of recesses and a second shield having openings for the third plurality of recesses and the fifth plurality of recesses.

19. The high-speed connector of claim 18 wherein the board-to-board receptacle further comprises a plurality of shield portions on the raised outer portion.

20. The high-speed connector of claim 18 wherein the board-to-board receptacle further comprises:

a fourth plurality of raised portions, each to support one of the first plurality of ground contacts; and a fifth plurality of raised portions, each to support one of the second plurality of ground contacts.

* * * * *